US010294713B2

(12) United States Patent
Holford et al.

(10) Patent No.: US 10,294,713 B2
(45) Date of Patent: May 21, 2019

(54) SHUTTER PANEL FOR AN ARCHITECTURAL OPENING

(71) Applicant: Hunter Douglas Inc., Pearl River, NY (US)

(72) Inventors: Michael S. Holford, Gilbert, AZ (US); James M. Anthony, Denver, CO (US); Joseph E. Kovach, Brighton, CO (US)

(73) Assignee: Hunter Douglas Inc., Pearl River, NY (US)

( * ) Notice: Subject to any disclaimer, the term of this patent is extended or adjusted under 35 U.S.C. 154(b) by 0 days.

(21) Appl. No.: 14/766,147

(22) PCT Filed: Mar. 14, 2013

(86) PCT No.: PCT/US2013/031780

§ 371 (c)(1),
(2) Date: Aug. 6, 2015

(87) PCT Pub. No.: WO2014/142932

PCT Pub. Date: Sep. 18, 2014

(65) Prior Publication Data

US 2015/0368959 A1 Dec. 24, 2015

(51) Int. Cl.
*E06B 7/09* (2006.01)
*E06B 7/096* (2006.01)
(Continued)

(52) U.S. Cl.
CPC ..... *E06B 7/096* (2013.01); *E06B 7/09* (2013.01); *E06B 7/10* (2013.01); *E06B 7/28* (2013.01);
(Continued)

(58) Field of Classification Search
CPC ..... E06B 7/086; E06B 3/5009; E06B 3/5036
See application file for complete search history.

(56) References Cited

U.S. PATENT DOCUMENTS 2,554,822 A * 5/1951 Geier ..... E06B 7/084 454/195
RE24,059 E * 9/1955 Pinion ..... E05F 1/063 16/318
(Continued)

FOREIGN PATENT DOCUMENTS

CA 2710407 7/2009
CN 201972562 9/2011

OTHER PUBLICATIONS

PCT International Search Report and Written Opinion for International application No. PCT/US2013/031780 dated May 31, 2013. 8 pages.

(Continued)

*Primary Examiner* — Catherine A Kelly
(74) *Attorney, Agent, or Firm* — Dority & Manning, P.A.

(57) ABSTRACT

A shutter panel for an architectural opening is provided. The shutter panel may include a frame and a louver rotatably coupled to the frame. The louver may be automatically closable based on an angular orientation of the louver. The shutter panel may include a closure device operably associated with the louver. The closure device may be actuated based on the angular orientation of the louver. The shutter panel may include a damping device operably associated with the louver. The damping device may be actuated based on the angular orientation of the louver. The shutter panel may include a tension device operably associated with the louver.

31 Claims, 24 Drawing Sheets

(51) Int. Cl.

| | |
|---|---|
| ***E06B 9/04*** | (2006.01) |
| ***E06B 7/10*** | (2006.01) |
| ***E06B 7/28*** | (2006.01) |
| *E05F 3/20* | (2006.01) |

(52) U.S. Cl.
CPC ..... *E06B 9/04* (2013.01); *E05F 3/20* (2013.01); *E05Y 2201/21* (2013.01); *E05Y 2201/264* (2013.01); *E05Y 2900/146* (2013.01)

(56) References Cited

U.S. PATENT DOCUMENTS 3,868,156 A * 2/1975 Vander Ley ..... A47B 49/004 16/318
4,255,899 A * 3/1981 Braithwaite ..... E06B 7/086 49/2
4,398,700 A * 8/1983 Thome ..... C21D 9/573 266/102
4,576,088 A 3/1986 Mathewes et al.
4,787,120 A * 11/1988 Haigh ..... A47K 3/36 16/317
4,864,691 A * 9/1989 Gidseg ..... E05D 3/04 16/312
4,999,948 A * 3/1991 Hodgens ..... E06B 7/086 49/74.1
5,216,837 A * 6/1993 Cleaver ..... E06B 7/086 49/74.1
5,347,756 A * 9/1994 Abbott ..... E06B 7/086 49/74.1
5,887,386 A * 3/1999 Alexanian ..... E06B 7/086 49/403
5,904,411 A * 5/1999 Hayakawa ..... E05D 15/582 16/289
6,014,839 A 1/2000 Ruggles
6,250,012 B1 * 6/2001 Ricci ..... E06B 7/086 49/74.1
7,168,475 B2 * 1/2007 Colson ..... E06B 7/086 160/168.1 R
7,574,827 B2 * 8/2009 Huang ..... E06B 7/096 49/403
7,628,195 B2 * 12/2009 Drew ..... E06B 7/086 160/176.1 R
7,963,071 B2 * 6/2011 Alexander ..... E06L 37/14 49/403
8,474,187 B2 * 7/2013 Marocco ..... E06B 7/086 49/403
8,640,305 B2 * 2/2014 Pecar ..... E05F 5/006 16/50
9,038,314 B2 * 5/2015 Chen ..... E06B 7/09 49/82.1
9,297,202 B2 * 3/2016 Watkins ..... E05F 17/00
9,732,553 B2 * 8/2017 Rotchell ..... E06B 7/096
2005/0246863 A1 * 11/2005 Chesworth ..... E05F 1/063 16/221
2008/0244979 A1 10/2008 Huang et al.
2010/0270113 A1 * 10/2010 Ogawa ..... A47K 13/12 188/281
2011/0041407 A1 * 2/2011 van de Bult ..... E06B 7/086 49/79.1
2015/0176327 A1 * 6/2015 Goyco-Graziani ..... E06B 7/086 49/89.1
2015/0184457 A1 * 7/2015 Zhang ..... E06B 9/322 160/133

OTHER PUBLICATIONS

Canadian Office Action dated Dec. 7, 2018 (5 pages).

* cited by examiner

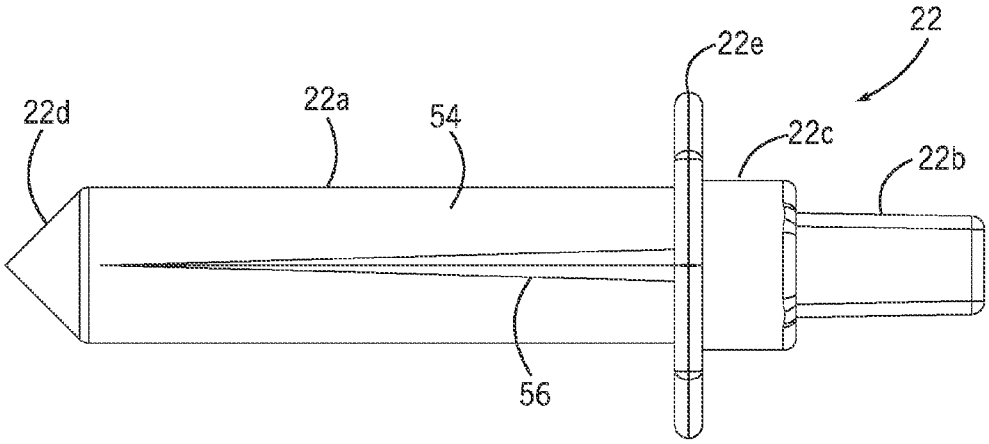
FIG. 4A
FIG. 4B
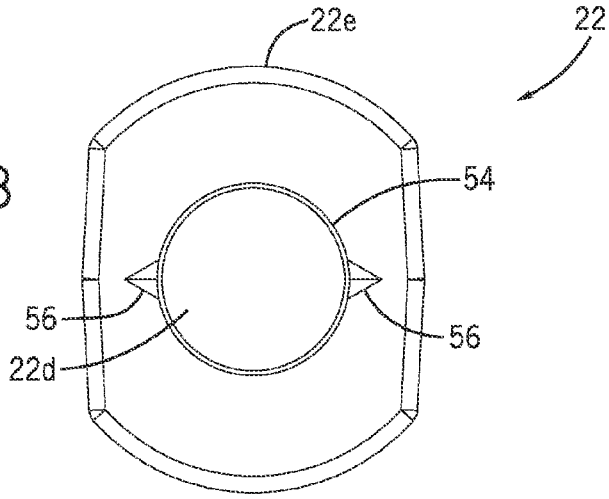
FIG. 4C
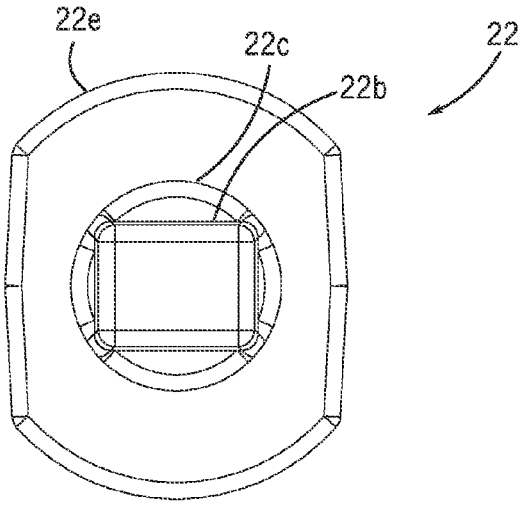

120a
118
128
124
126
122
120b
141

SHUTTER PANEL FOR AN ARCHITECTURAL OPENING

CROSS-REFERENCE TO RELATED APPLICATION

This application is the national stage application of International Patent Application No. PCT/US2013/031780, filed Mar. 14, 2013, entitled "Shutter Panel For an Architectural Opening" which is hereby incorporated by reference herein in its entirety for all purposes.

FIELD

The present disclosure relates generally to shutters for architectural openings and, more particularly, to a louvered shutter for an architectural opening.

BACKGROUND

Louvered shutters for architectural openings, such as doors, windows, and the like, have taken numerous forms for many years. Louvered shutters generally provide adjustable light and privacy control through the inclusion of multiple rotatable louvers. In operation, consumers may rotate the louvers to a desired position that provides a preferred amount of light and privacy.

SUMMARY

Examples of the disclosure may include a shutter panel for an architectural opening. The shutter panel may include a frame and a louver rotatably coupled to the frame and automatically closable based on an angular orientation of the louver. The shutter panel may include a closure device operably associated with the louver and actuated based on an angular orientation of the louver.

In another example, the shutter panel may include a frame, a louver rotatably coupled to the frame, and a closure device operably associated with the louver and configured to move the louver. The closure device may be actuated based on an angular orientation of the louver. The closure device may be automatically actuated or self-actuated based on the angular orientation of the louver. The closure device may be configured to rotate the louver toward a closed position, such as a fully-closed position.

The closure device may include a first cam member and a second cam member. The first cam member may be rotatable relative to the second cam member. The second cam member may be non-rotatable relative to the first cam member. The second cam member may be slidable relative to the first cam member. One of the first cam member or the second cam member may include a protuberance, and the other of the first cam member or the second cam member may include a recessed area configured to receive the protuberance. The first cam member and the second cam member may be aligned along a common axis. The first cam member and the second cam member may be at least partially received within a common housing.

The shutter panel may include a louver pin. The louver pin may interconnect the louver and the frame. The louver pin may be non-rotatably coupled to the first cam member. The first cam member, the second cam member, and the louver pin may be aligned along a common axis. The first cam member, the second cam member, and the louver pin may be at least partially received within a common housing.

The closure device may include a biasing element. The biasing element may bias the second cam member into contact with the first cam member. The first cam member, the second cam member, and the biasing element may be aligned along a common axis. The first cam member, the second cam member, and the biasing element may be at least partially received within a common housing. The housing may include an outer envelope of about one inch in length and about three-eighths of an inch in diameter.

The shutter panel may include a damping device operably associated with the louver. The damping device may include an angular range of disengagement or non-engagement, or a deadband. The damping device may include a damper, such as a linear damper or a rotary damper. The damper may be fluid-based, spring-based, or both. The damper may provide a damping rate that controls or governs a louver closure speed. The damping device may include a centering device configured to substantially center the damper within the angular range of non-engagement of the damping device. The damper may be actuated substantially simultaneously with the closure device. The closure device and the damper may be aligned along a common axis. The closure device and the damping device may be at least partially received within a common housing. The shutter panel may include a tension device operably associated with the louver.

In another example, the shutter panel may include a frame, a louver rotatably coupled to the frame, and a damping device operably associated with the louver and configured to resist movement of the louver. The damping device may be actuated based on an angular orientation of the louver. The damping device may be automatically actuated or self-actuated based on the angular orientation of the louver. The damping device may be configured to control the rate of movement of the louver from an open position toward a closed position, such as a fully-closed position.

The damping device may include a deadband device configured to selectively engage or disengage a damper based on the angular orientation of the louver. The deadband device may include a first deadband member and a second deadband member. The first deadband member may be non-rotatably coupled to the louver. The first deadband member may be rotatable relative to the second deadband member. The first deadband member and the second deadband member may be aligned along a common axis. The second deadband member may be angularly offset relative to the first deadband member about the common axis when the damping device is in a disengaged state. The second deadband member may be angularly aligned with the first deadband member about the common axis when the damping device is in an engaged state.

The damping device may include a damper, such as a linear damper or a rotary damper. The damper may be fluid-based, spring-based, or both. The damper may provide a damping rate that controls or governs a louver closure speed. The damping device may include a centering device configured to substantially return the damper to an initial state associated with a midpoint of a deadband range of the damping device. The centering device may include a first centering member and a second centering member. The first centering member may be non-rotatably coupled to the second deadband member. The first centering member may be rotatable relative to the second centering member. The second centering member may be non-rotatable relative to the first centering member. The second centering member may be slidable relative to the first centering member. One of the first centering member or the second centering member may include a protuberance, and the other of the first centering member or the second centering member may include a recessed area configured to receive the protuberance. The protuberance may be a wedge. The recessed area may be a groove. The protuberance may be a lobe, which may extend outward from a side of the centering member. The recessed area may be defined by a trough and opposing sidewalls of a leaf spring.

The first centering member and the second centering member may be aligned along a common axis. The first centering member and the second centering member may be at least partially received within a common housing. The first deadband member, the second deadband member, first centering member, and the second centering member may be aligned along a common axis. The first deadband member, the second deadband member, first centering member, and the second centering member may be at least partially received within a common housing. The housing may include an outer envelope of about one inch in length and about three-eighths of an inch in diameter.

The damping device may include a biasing element. The biasing element may bias the second centering member into contact with the first centering member. The first centering member, the second centering member, and the biasing element may be aligned along a common axis. The first centering member, the second centering member, and the biasing element may be at least partially received within a common housing.

The shutter panel may include a louver pin. The louver pin may interconnect the louver and the frame. The louver pin may be non-rotatably coupled to the first deadband member. The first deadband member, the second deadband member, and the louver pin may be aligned along a common axis. The first deadband member, the second deadband member, and the louver pin may be at least partially received within a common housing. The first deadband member, the second deadband member, the first centering member, the second centering member, the biasing element, and the louver pin may be aligned along a common axis. The first deadband member, the second deadband member, the first centering member, the second centering member, the biasing element, and the louver pin may be at least partially received within a common housing.

The shutter panel may include a closure device operably associated with the louver. The damping device may be actuated substantially simultaneously with the closure device. The damping device and the closure device may be aligned along a common axis. The damping device and the closure device may be at least partially received within a common housing. The shutter panel may include a tension device operably associated with the louver. The damping device and the tension device may be aligned along a common axis.

In another example, the shutter panel may include a frame, a louver rotatably coupled to the frame, and a tension device operably associated with the louver and configured to retain the louver in an angular orientation. The tension device may include a first tension member non-rotatably coupled to the louver, a second tension member slidable relative to the first tension member, and a biasing element biasing the second tension member into contact with the first tension member. The first tension member may be non-rotatably coupled to a louver pin. The first tension member may be rotatable relative to the second tension member. The second tension member may be non-rotatable relative to the first tension member. The first tension member, the second tension member, and the biasing element may be at least partially received within a common housing. The louver pin, the first tension member, the second tension member, and the biasing element may be at least partially received within a common housing. The first tension member, the second tension member, and the biasing element may be aligned along a common axis. The louver pin, the first tension member, the second tension member, and the biasing element may be at least partially received within a common housing. The housing may include an outer envelope of about one inch in length and about three-eighths of an inch in diameter. The tension device may be configured to resist movement of the louver regardless of an angular orientation of the louver.

This summary of the disclosure is given to aid understanding, and one of skill in the art will understand that each of the various aspects and features of the disclosure may advantageously be used separately in some instances, or in combination with other aspects and features of the disclosure in other instances. Accordingly, while the disclosure is presented in terms of examples, it should be appreciated that individual aspects of any example can be claimed separately or in combination with aspects and features of that example or any other example.

This summary is neither intended nor should it be construed as being representative of the full extent and scope of the present disclosure. The present disclosure is set forth in various levels of detail in this application and no limitation as to the scope of the claimed subject matter is intended by either the inclusion or non-inclusion of elements, components, or the like in this summary. Moreover, reference made herein to "the present invention" or aspects thereof should be understood to mean certain examples of the present disclosure and should not necessarily be construed as limiting all examples to a particular description.

BRIEF DESCRIPTION OF THE DRAWINGS

The accompanying drawings, which are incorporated in and constitute a part of the specification, illustrate examples of the disclosure and, together with the general description given above and the detailed description given below, serve to explain the principles of these examples.

FIG. 4A is a side elevation view of a louver pin associated with the louver closure assembly of FIGS. 2A-2C.

FIG. 4B is an elevation view of an end of the louver pin of FIG. 4A.

FIG. 4C is an elevation view of an opposite end of the louver pin of FIG. 4A relative to FIG. 4B.

Figure 1A:
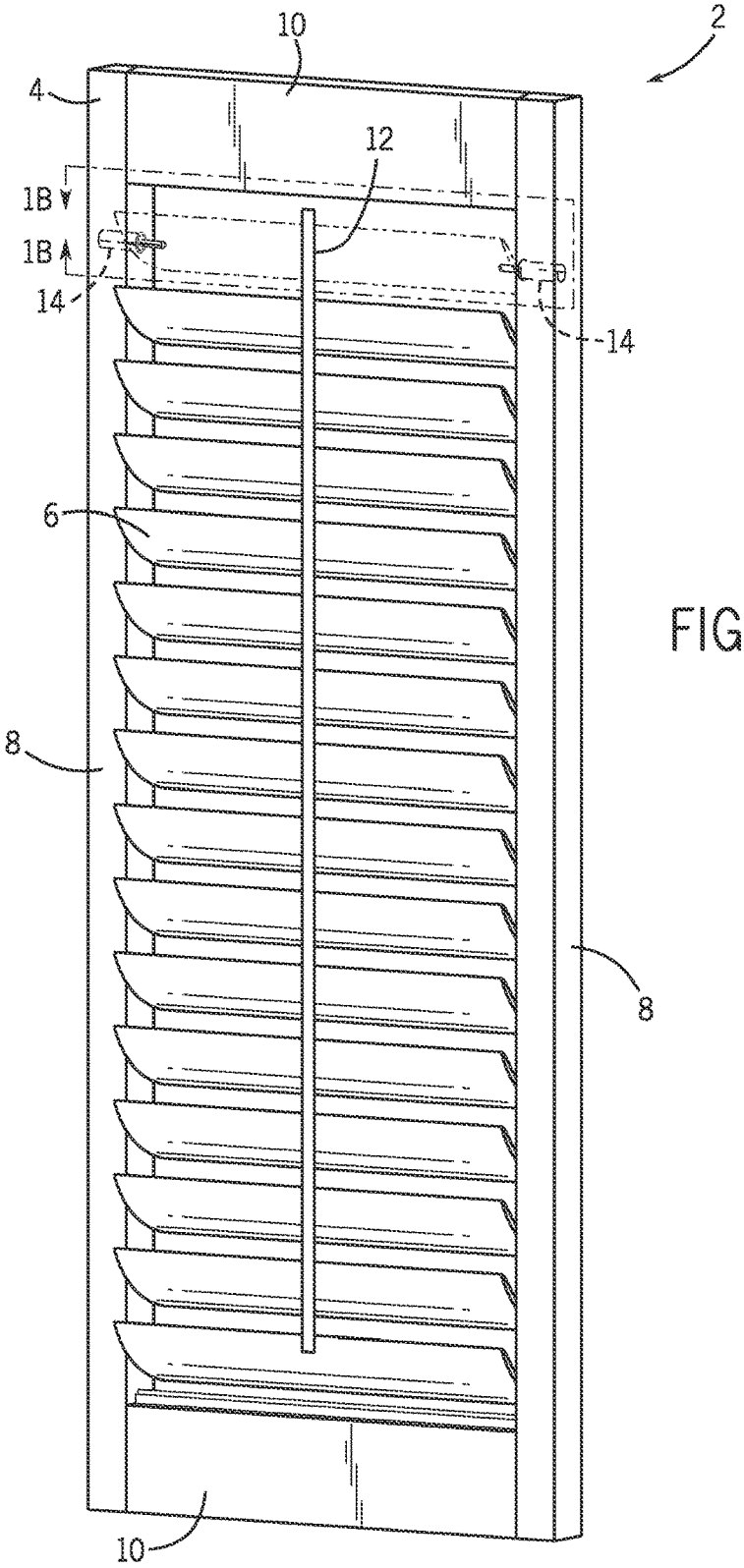
FIG. 1A is an isometric view of a shutter panel.

It should be understood that the drawings are not necessarily to scale. In certain instances, details that are not necessary for an understanding of the disclosure or that render other details difficult to perceive may have been omitted. In the appended drawings, similar components and/or features may have the same reference label. Further, various components of the same type may be distinguished by following the reference label by a letter that distinguishes among the similar components. If only the first reference label is used in the specification, the description is applicable to any one of the similar components having the same first reference label irrespective of the second reference label. It should be understood that the claimed subject matter is not necessarily limited to the particular examples or arrangements illustrated herein.

DETAILED DESCRIPTION

The present disclosure relates to a shutter panel for an architectural opening. The shutter panel may include one or more rotatable louvers. For shutter panels with multiple louvers, the louvers may be linked together by a tilt bar, a gear track system, a pulley system, or another operating system. To move the louvers, a force may be applied directly to a louver or indirectly to a louver through the operating system.

The shutter panel may include a closure feature. For example, during rotation of a louver toward a closed position, the louver may be automatically closed after reaching a certain angular orientation. The automatic closure of the louver may occur without user actuation or interaction. The automatic closure of the louver may ensure a full panel closure, thereby addressing any stacked tolerance issues with the shutter panel.

The shutter panel may include a closure device operably associated with the louver and configured to move the louver. The closure device may be actuated based on an angular orientation of the louver relative to a fully closed position. In some implementations, the closure device is actuated based on the louver being oriented between about 1 degree and about 30 degrees from a fully closed position. In some implementations, the closure device is actuated based on the louver being oriented between about 10 degrees and about 20 degrees from a fully closed position. In some implementations, the closure device is actuated based on the louver being oriented at about 15 degrees from a fully closed position. Upon actuation, the closure device may drive or rotate the louver into the fully closed position.

Additionally or alternatively, the shutter panel may include a damping feature. For example, during rotation of a louver toward a closed position, the rate of louver rotation may be automatically damped after the louver reaches a certain angular orientation. The automatic damping of the rate of motion of the louver may occur without user actuation or interaction. The automatic damping of the rate of louver motion may ensure a substantially consistent, controlled, slow, smooth, and/or soft panel closure.

The shutter panel may include a damping device operably associated with the louver and configured to resist movement of the louver. The damping device may be actuated based on an angular orientation of the louver relative to a fully closed position. In some implementations, the damping device is actuated based on the louver being oriented between about 1 degree and about 30 degrees from a fully closed position. In some implementations, the damping device is actuated based on the louver being oriented between about 10 degrees and about 20 degrees from a fully closed position. In some implementations, the damping device is actuated based on the louver being oriented at about 15 degrees from a fully closed position.

Upon actuation, the damping device may control a rate of louver movement. In some implementations, the damping device is used in a shutter panel employing a closure device. In these implementations, upon actuation, the damping device may control or govern a rate of closure of the closure device and may provide a substantially consistent, controlled, smooth, and/or slow closure of the louver. In these implementations, the damping device may be actuated before, simultaneously, substantially simultaneously, or after the closure device is actuated.

Additionally or alternatively, the shutter panel may include a tensioning feature. For example, once a louver is positioned in a desired orientation, the louver may be automatically held or retained in the desired orientation until a subsequent reorienting force is applied to the louver. The automatic orientation retention of the louver may occur without user actuation or interaction. The automatic tensioning of the louver may ensure the louver remains in the desired orientation without inadvertent rotational slippage of the louver relative to a frame, substantially regardless of the tolerance between a louver pin and a receiving hole formed in the frame.

The shutter panel may include a tensioning device operably associated with the louver and configured to retain the louver in a desired angular orientation. The tensioning device may provide substantially constant and/or uniform friction or tension to the louver substantially regardless of the angular orientation of the louver. The tensioning device may be substantially unaffected by tolerance differences between the tensioning device and a receiving hole or cavity defined by a frame. The tensioning device may be used in a shutter panel employing a closure device, a damping device, or both.

Referring to FIG. 1A, a shutter panel 2 for an architectural opening, such as a door, a window opening, or the like, is provided. The shutter panel 2 may include a frame 4 and one or more louvers or slats 6. The frame 4 may include a pair of spaced apart, substantially-vertical members or stiles 8 interconnected together by a pair of spaced apart, substantially-horizontal members or rails 10. Collectively, the stiles 8 and the rails 10 may form a perimeter of the frame 4 and define an interior space configured to receive the louvers 6. Although a rectangular frame 4 is depicted, the frame 4 may be formed in substantially any shape (e.g., semi-circular) to accommodate various architectural openings.

The louvers 6 may be positioned within the interior space defined by the frame 4 and may be rotatably coupled to the frame 4. As illustrated in FIG. 1A, the louvers 6 may extend between the stiles 8 in a transverse orientation (e.g., perpendicular) relative to the stiles 8. The louvers 6 may be individually attached to the stiles 8 so that a single louver 6 may be replaced if damaged. Each louver 6 may be rotatable or tiltable about a longitudinal axis of the respective louver 6 between open and closed positions. In a fully opened position, each louver 6 may be positioned substantially perpendicular to the associated architectural opening to provide a minimum amount of privacy and a maximum amount of light passage. In this opened position, immediately adjacent louvers 6 may be separated from each other by a maximum distance. In a fully closed position, immediately adjacent louvers 6 may contact or abut one another to provide a maximum amount of privacy and a minimum amount of light passage. In this closed position, immediately adjacent louvers 6 may be separated from each other by a minimum distance. The louvers 6 may include one or two fully closed positions depending on the type of shutter panel 2. For shutter panels with two closed positions, each closed position may be associated with an opposite end of travel of a respective louver 6.

The louvers 6 may be coupled or grouped together so that the louvers rotate substantially in unison. For example, a tilt bar 12 may be attached to each louver 6 to link the individual louvers together so that movement of the tilt bar 12 causes a substantially uniform movement of the louvers 6. Alternatively, each louver 6 may be operably associated with a gear track system embedded within each stile 8. A slider knob or other actuator may be operably associated with the gear track system to substantially uniformly move the louvers 6. Alternatively, each louver 6 may be operably associated with a pulley system embedded within each stile 8. A slider knob or other actuator may be operably associated with the pulley system to substantially uniformly move the louvers 6.

Figure 1B:
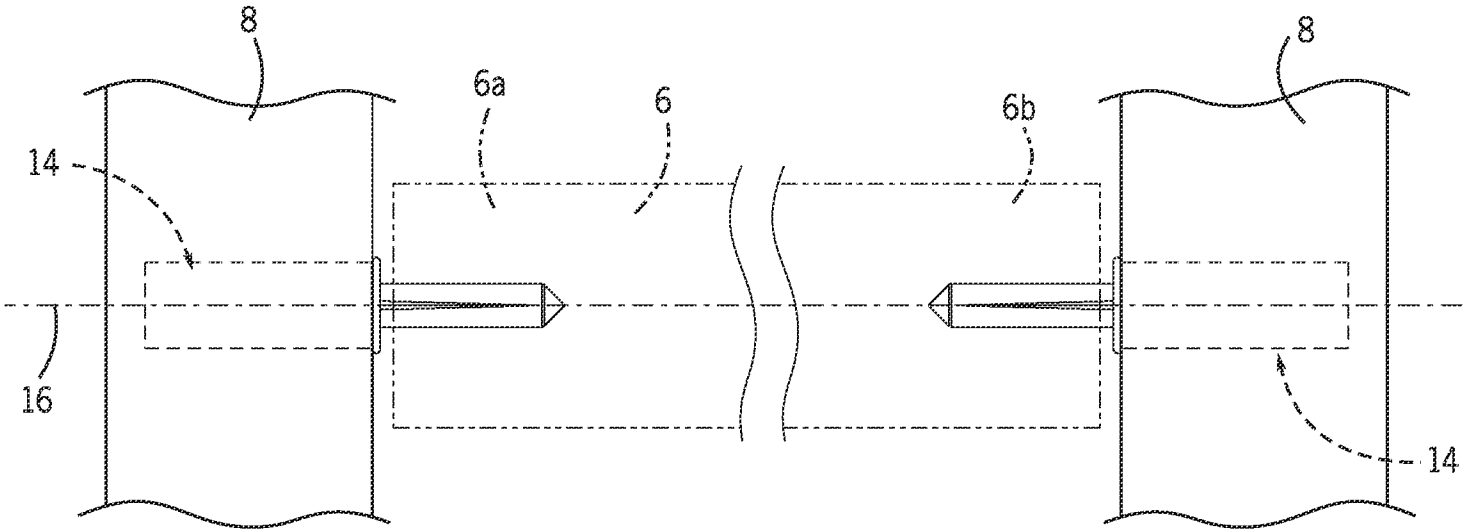
FIG. 1B is an enlarged front elevation view of a section of the shutter panel of FIG. 1 taken along the line 1B-1B illustrated in FIG. 1A.

With reference to FIGS. 1A and 1B, each louver 6 may be rotatably attached to the stiles 8 by a pair of louver devices 14*a*, 14*b*. One louver device 14*a* may be received within a stile 8 and a first end 6*a* of a respective louver 6. The other louver device 14*b* may be received within an opposing stile 8 and a second end 6*b* of the respective louver 6. The louver devices 14*a*, 14*b* may be substantially aligned along a longitudinal axis 16 of the respective louver 6. The louver devices 14*a*, 14*b* may be a standard louver pin, a louver closure device, a louver damping device, a louver tension device, or any combination thereof.

Figure 2A:
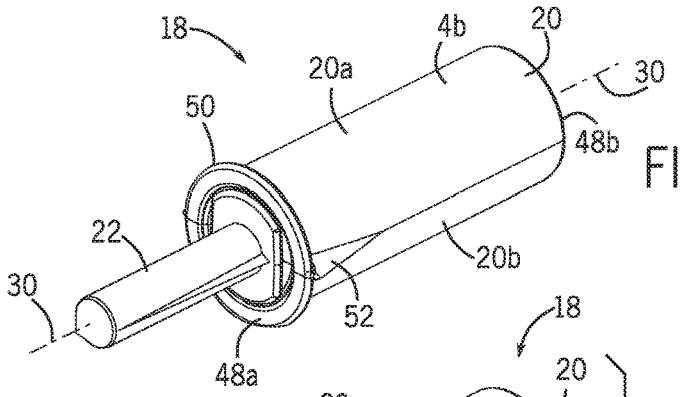
FIG. 2A is an isometric view of a louver closure assembly.
Figure 2B:
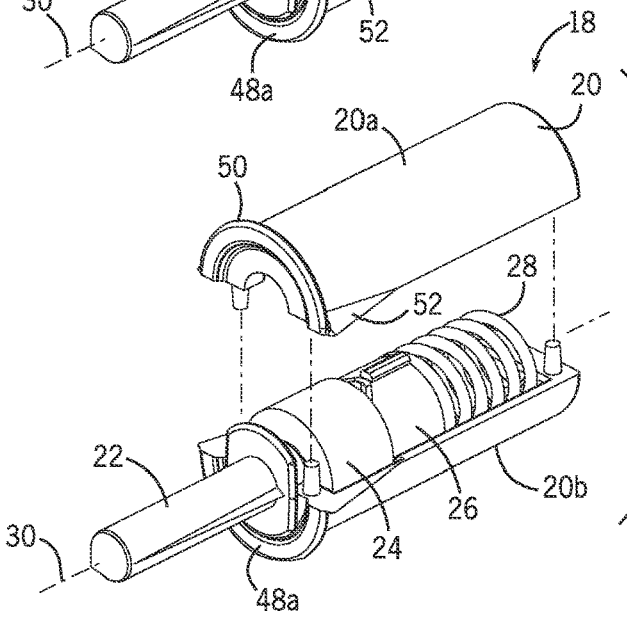
FIG. 2B is a partially-exploded, isometric view of the louver closure assembly of FIG. 2A.
Figure 2C:
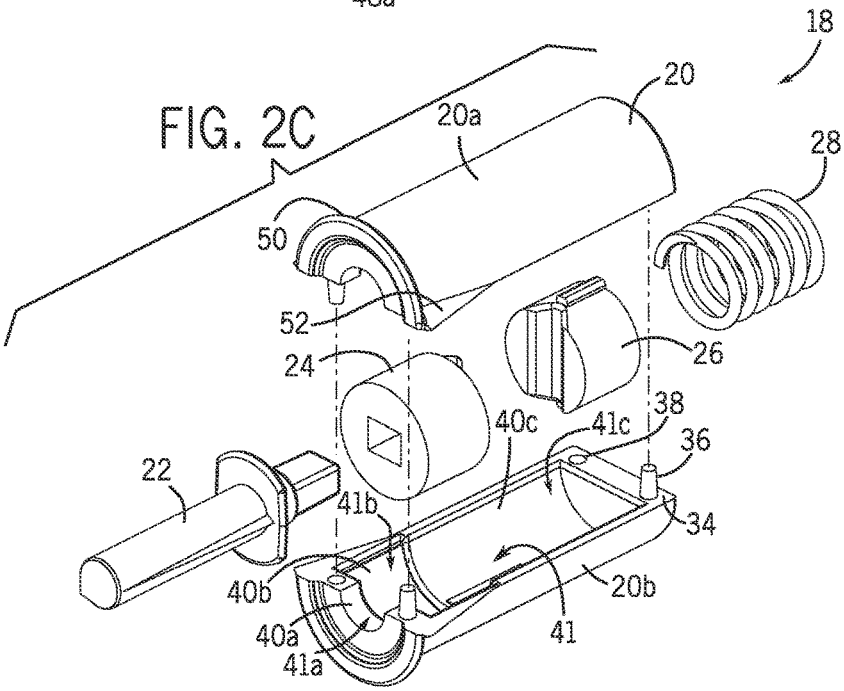
FIG. 2C is a fully-exploded, isometric view of the louver closure assembly of FIG. 2A.
Figure 3A:
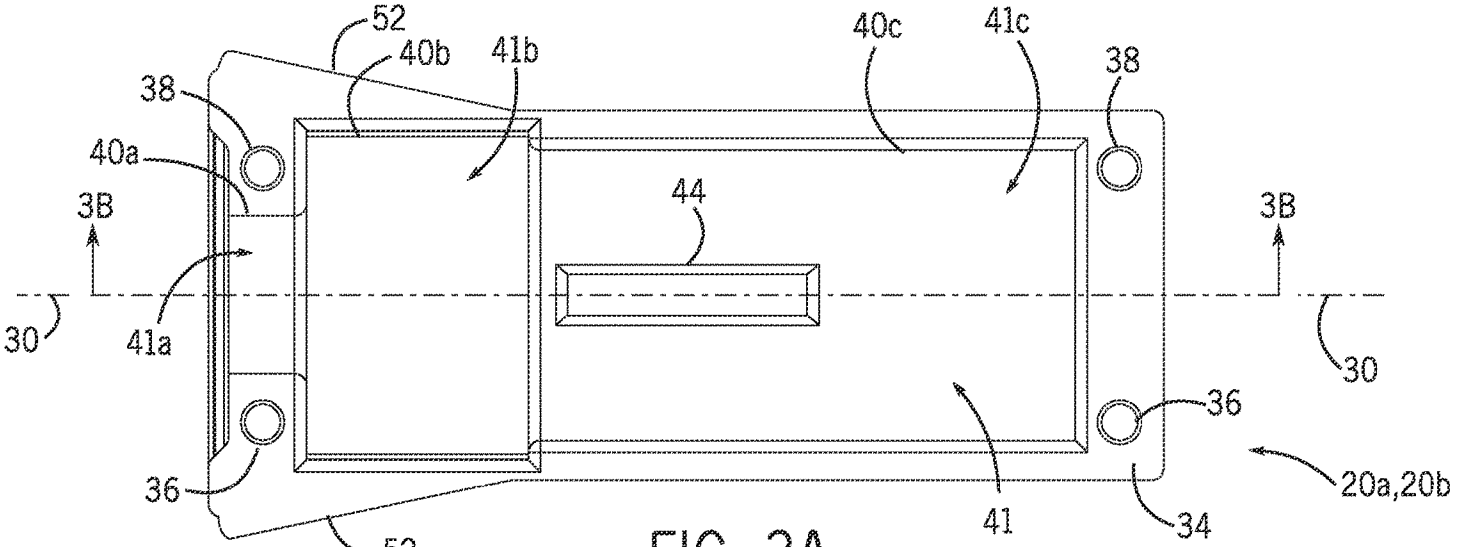
FIG. 3A is a top plan view of one-half of a housing of the louver closure assembly of FIGS. 2A-2C.
Figure 3B:
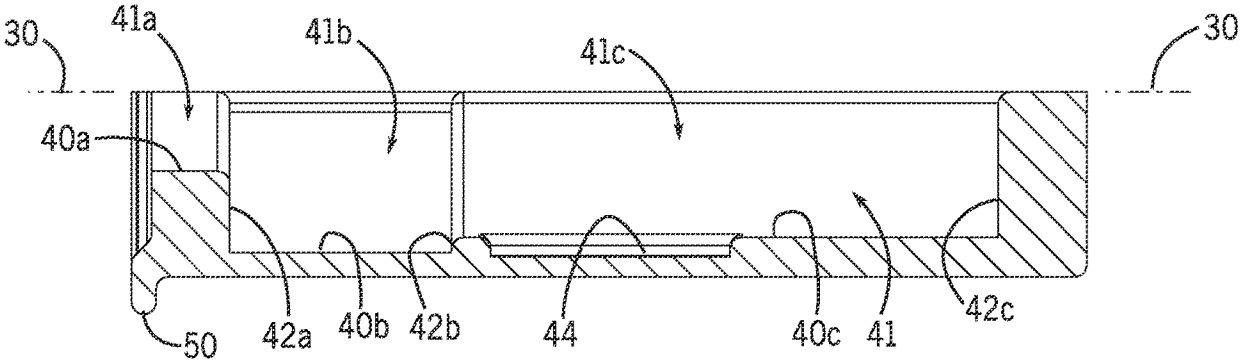
FIG. 3B is a longitudinal cross-sectional view of the housing of FIG. 3A taken along the line 3B-3B illustrated in FIG. 3A.

With reference to FIGS. 2A-2C, a louver closure device 18 is provided. The closure device 18 may include a housing or shell 20, a louver pin 22, a rotary cam 24, a linear cam 26, and a helically-wound compression spring 28, all of which may be aligned along a longitudinal axis 30 of the louver closure device 18. The rotary cam 24 and the linear cam 26 may be positioned between the louver pin 22 and the compression spring 28 along the longitudinal axis 30 of the louver closure device 18. The rotary cam 24, the linear cam 26, and the compression spring 28 may be substantially encased or surrounded by the housing 20 while the louver pin 22 may extend outward from the housing 20. The louver pin 22 and the rotary cam 24 may be rotatable relative to the housing 20 while the linear cam 26 may be non-rotatable relative to the housing 20.

With reference to FIGS. 2A-3B, the housing 20 may be configured to receive at least a portion of the louver pin 22, the rotary cam 24, the linear cam 26, and the compression spring 28. The housing 20 may be formed as single part or multiple separable parts. In implementations where the housing is formed with multiple parts, the housing may include any number of parts, such as two or more parts. In one implementation, the housing includes two substantially identical halves, which may snugly fit together to encompass or surround at least some of the other components of the pin assembly.

With continued reference to FIGS. 2A-3B, the housing 20 may be formed as two housing members 20*a*, 20*b* that may be substantially identical to one another. Each housing member 20*a*, 20*b* may form a lengthwise half of the housing 20. Each housing member 20*a*, 20*b* may include a peripheral, substantially planar abutment surface 34 extending lengthwise along the respective housing member 20*a*, 20*b*. A pair of interference pins 36 may protrude from each abutment surface 34 and may be snugly received within corresponding pin holes 38 formed in an opposing abutment surface 34 to secure the two housing members 20*a*, 20*b* together.

When assembled, the housing members 20*a*, 20*b* may define a series of substantially cylindrical inner walls 40*a*, 40*b*, 40*c* axially spaced along the longitudinal axis 30 of the louver closure device 18. The inner walls 40*a*, 40*b*, 40*c* may define axially-spaced, contiguous sub-cavities 41*a*, 41*b*, 41*c* that may collectively form an internal cavity 41 of the housing 20. The inner walls 40*a*, 40*b*, 40*c* each may have a different radius, thereby defining a series of shoulders 42*a*, 42*b* that form transitions between adjacent inner walls 40*a*, 40*b*, 40*c*. The shoulders 42*a*, 42*b* may be oriented substantially perpendicular to the longitudinal axis 30. A longitudinally-extending slot 44 may be formed in one of the inner walls 40*c*.

The housing 20 may include a substantially cylindrical outer surface 46 extending lengthwise between opposing ends 48*a*, 48*b* of the housing 20. The ends 48*a*, 48*b* of the housing 20 may be spaced apart from one another along the longitudinal axis 30 and may be oriented substantially perpendicular to the outer surface 46 of the housing 20. A circumferential flange 50 may extend radially outward from the outer surface 46 of the housing 20 adjacent one of the ends 48*a* of the housing. When attached to a shutter panel 2, the substantially cylindrical outer surface 46 of the housing 20 may be positioned within a receiving hole formed in a member of the shutter panel 2 (such as a louver 6, a stile 8, or a rail 10) and the circumferential flange 50 may abut a wall surrounding the hole to substantially prevent further insertion of the housing 20 into the hole. A pair of longitudinally-extending fins 52 may protrude radially outward from the outer surface 46 of the housing 20. The fins 52 may key into an inner wall of the shutter panel member that defines the hole to substantially prevent rotation of the housing 20 within the hole. Although depicted as substantially cylindrical, the outer surface 46 of the housing 20 may be formed in various transverse cross-sectional shapes, such as rectangular, triangular, or other suitable shapes.

With reference to FIGS. 4A-4C, the louver pin 22 may include a first keyed portion 22*a*, a second keyed portion 22*b*, and a substantially cylindrical journal portion 22*c* positioned longitudinally between the first and second keyed portions 22*a*, 22*b*. The first keyed portion 22*a* may include a pair of longitudinally-extending fins 56 protruding outward from opposing sides of a substantially cylindrical outer wall 54. The second keyed portion 22*b* of the louver pin 22 may have a rectangular transverse cross-sectional shape. The first and second keyed portions 22*a*, 22*b* may include any suitable keyed shape.

With reference back to FIGS. 2A-2C, the louver pin 22 may be positioned coaxial along the longitudinal axis 30 of the louver closure device 18. The louver pin 22 may be oriented relative to the housing 20 so that the first keyed portion 22*a* of the louver pin 22 protrudes from an end 48*a* of the housing 20, the second keyed portion 22*b* of the louver pin 22 protrudes into the inner cavity 41*b* of the housing 20, and the journal portion 22*c* of the louver pin 22 is journaled within the inner wall 40*a* of the housing 20. As such, the louver pin 22 may be rotatably supported by the housing 20 and may transfer rotation between components associated with the first and second keyed portions 22*a*, 22*b* of the louver pin 22.

The louver pin 22 also may include a tip portion 22*d*, which may be integrally formed with and extend longitudinally away from one end of the first keyed portion 22*a*. The tip portion 22*d* of the louver pin 22 may align the louver pin 22 within a louver pin receiving hole, which may be formed in an end of a louver 6, a stile 8, a rail 10, or the like. The tip portion 22*d* may be substantially conical (FIGS. 2A-2C and 4A-4B), pyramidal, frustum, or any other suitable longitudinally tapering shape.

The louver pin 22 further may include a collar portion 22*e*, which may extend radially outward from an opposite end of the first keyed portion 22*a* relative to the tip portion 22*d*. The collar portion 22*e* may be adjacent the journal portion 22*c* of the louver pin 22. The collar portion 22*e* of the louver pin 22 may abut one end 48*a* of the housing 20 (FIG. 2A) to substantially prevent further insertion of the louver pin 22 into the internal cavity 41 of the housing 20. The collar portion 22*e* may be inset into the end 48*a* of the housing to reduce an effective length of the assembled housing 20 and louver pin 22, to provide an aesthetic appearance, or both. The collar portion 22*e* may be formed in various transverse cross-sectional shapes.

The housing 20 and the louver pin 22 may be non-rotatably secured to different structures of the shutter panel 2 so that rotation of one structure relative to the other structure of the shutter panel 2 causes relative rotation between the housing 20 and the louver pin 22. For example, the housing 20 may be non-rotatably secured to a stile 8. In this example, the louver pin 22 may protrude from an end of the housing 20 and may be non-rotatably secured to a corresponding louver 6. As such, rotation of the louver 6 may rotate the louver pin 22 relative to the housing 20. As another example, the housing 20 may be non-rotatably secured to a louver 6. In this example, the louver pin 22 may protrude from an end of the housing 20 and may be non-rotatably secured to a stile 8. As such, rotation of the louver 6 may rotate the housing 20 relative to the louver pin 22. The housing 20 and the louver pin 22 may be non-rotatably embedded within the different structures of the shutter panel 2.

With reference to FIGS. 5A-5D, the rotary cam 24 may include a substantially cylindrical body 58 having a substantially cylindrical outer wall 60 extending longitudinally between and terminating at opposing ends 62*a*, 62*b* of the body 58, both of which may be oriented substantially perpendicular to the substantially cylindrical outer wall 60. The body 58 may include an internal wall 64 that defines a receptacle 66 that opens through one end 62*a* of the body 58. The receptacle 66 may be configured to receive the second keyed portion 22*b* of the louver pin 22. The interface between the internal wall 64 of the body 58 and the second keyed portion 22*b* of the louver pin 22 may be configured to transmit rotational movement or torque. The second keyed portion 22*b* of the louver pin 22 and the internal wall 64 of the rotary cam 24 may have various corresponding keyed shapes, such as the depicted rectangular transverse cross-sectional shape. Alternatively, the louver pin 22 and the rotary cam 24 may be integrally formed as a single part.

The rotary cam 24 may include an alignment key and the linear cam 26 may include a complementary alignment feature. For example, the rotary and linear cams 24, 26 may include a complementary protuberance and groove. As another example, the rotary and linear cams 24, 26 may include a complementary spring-biased detent (such as a ball detent) and recessed receiving area. With continued reference to FIGS. 5A-5D, a transversely-extending protuberance 67 may extend from the other end 62*b* of the body 58 and may define a cam surface 68. The cam surface 68 may include opposing sloped surfaces 68*a*, 68*b* that extend away from the end 62*b* of the body 58 at an angle β. The sloped surfaces 68*a*, 68*b* may converge together as the surfaces 68*a*, 68*b* extend away from the end 62*b* and may intersect at a transversely-extending peak 68*c*, which may be rounded. In some implementations, the angle α is between about 115 degrees and about 155 degrees. In one implementation, the angle α is about 135 degrees. The protuberance 67 may be integrally formed with the body 58 of the rotary cam 24. Alternatively, the protuberance 67 and the body 58 of the rotary cam 24 may be formed separately and attached together.

With reference back to FIGS. 2A-3B, the rotary cam 24 may be positioned within the cavity 41*b* of the housing 20 and may be rotatable relative to the housing 20 about the longitudinal axis 30 of the louver closure device 18. In one implementation, the substantially cylindrical outer wall 60 of the rotary cam 24 is clearance fit within the inner wall 40*b* of the housing 20 to form a small annular gap between the outer wall 60 and the inner wall 40*b*. In this implementation, the second keyed portion 22*b* of the louver pin 22 may centrally locate the rotary cam 24 along the longitudinal axis 30 of the housing 20. In another implementation, the substantially cylindrical outer wall 60 of the rotary cam 24 is substantially congruent with and rotatably bears against the inner wall 40*b* of the housing 20.

The rotary cam 24 may be oriented within the sub-cavity 41*b* of the housing 20 so that the receptacle 66 may open to the sub-cavity 41*a* (FIGS. 2A-3B). In this orientation, the journal portion 22*c* of the louver pin 22 may rotatably bear against the inner wall 40*a* of the housing 20 and the second keyed portion 22*b* of the louver pin 22 may extend into the receptacle 66 to non-rotatably couple the first keyed portion 22*a* of the louver pin 22 and the rotary cam 24. The end 62*a* of the body 58 of the rotary cam 24 may confront the shoulder 42*a* of the housing 20, and the opposite end 62*b* of the body 58 may confront the shoulder 42*b* of the housing 20 (see FIGS. 7A-9B). The shoulders 42*a*, 42*b* of the housing 20 may substantially restrain the axial or longitudinal position of the rotary cam 24 relative to the housing 20.

Figure 6A:
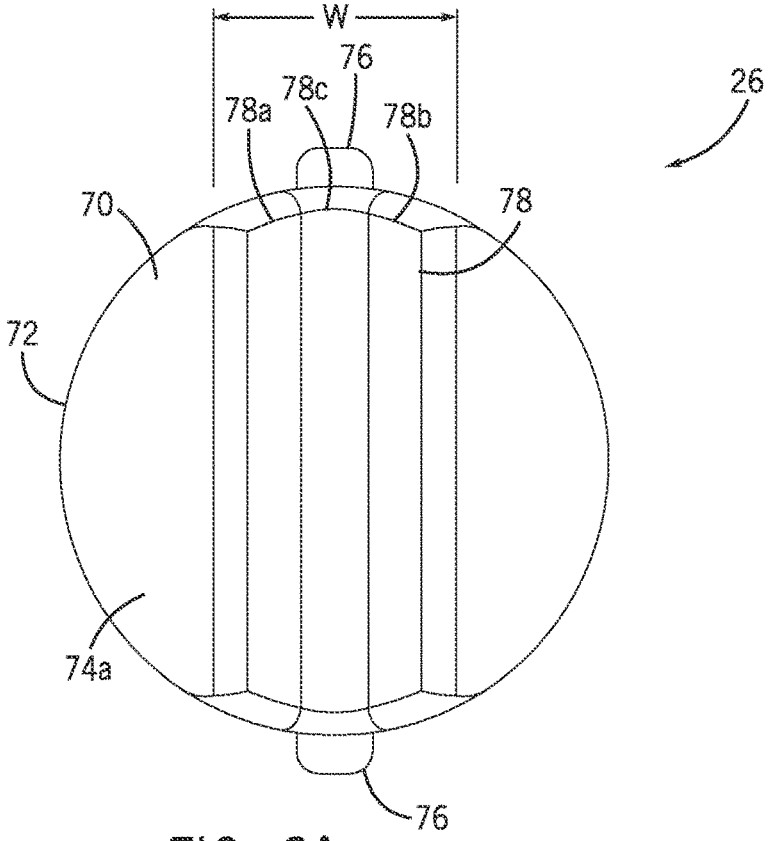
FIG. 6A is an elevation view of an end of a linear cam of the louver closure assembly of FIGS. 2A-2C.
Figure 6B:
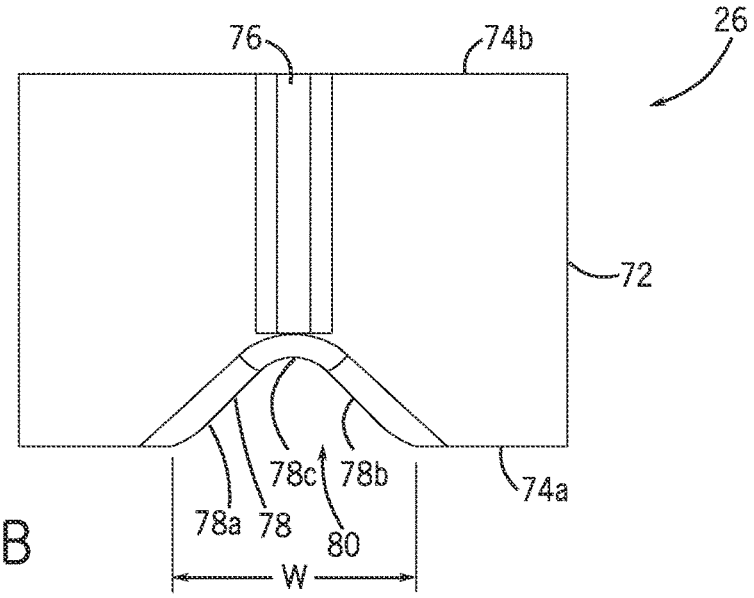
FIG. 6B is a top plan view of the linear cam of FIG. 6A.

With reference to FIGS. 6A-6B, the linear cam 26 may include a substantially cylindrical body 70 having a substantially cylindrical outer wall 72 extending longitudinally between and terminating at opposing ends 74*a*, 74*b* of the body 70, both of which may be oriented substantially perpendicular to the substantially cylindrical outer wall 72. A pair of longitudinally-extending ribs 76 may protrude radially outward from the outer wall 72 of the body 70 of the linear cam 26. The ribs 76 may be diametrically opposed about the outer wall 72 and may be received within corresponding slots 44 formed in the inner wall 40*c* of the housing 20 (see FIGS. 7B, 8B, and 9B).

Figure 5A:
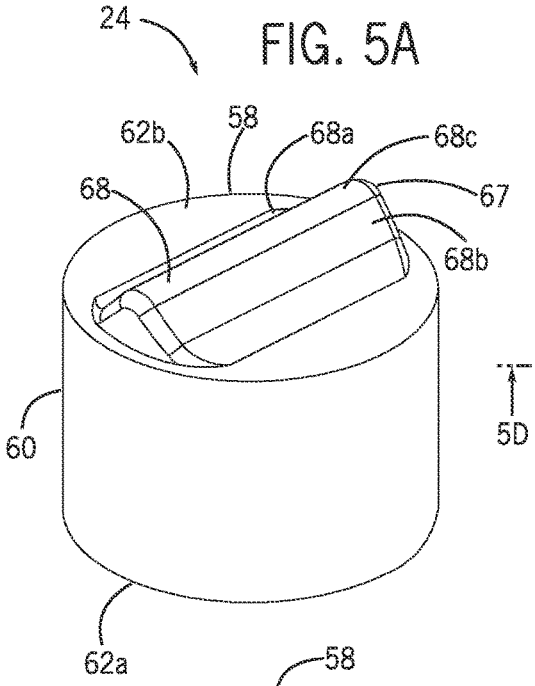
FIG. 5A is an isometric view of a rotary cam of the louver closure assembly of FIGS. 2A-2C.
Figure 5B:
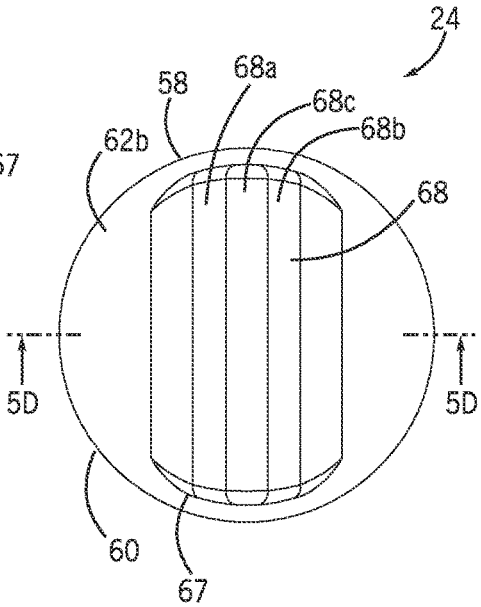
FIG. 5B is an elevation view of an end of the rotary cam of FIG. 5A.
Figure 5C:
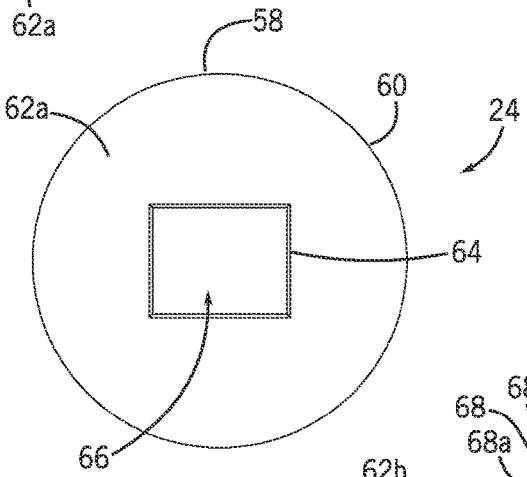
FIG. 5C is an elevation view of an opposite end of the rotary cam of FIG. 5A relative to FIG. 5B.
Figure 5D:
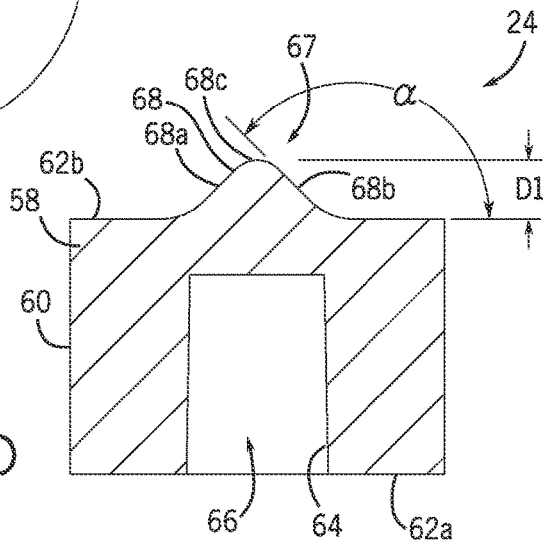
FIG. 5D is a top plan view of the rotary cam of FIG. 5A.

The linear cam 26 may be slidable relative to the housing 20. With reference to FIGS. 7B, 8B, and 9B, the ribs 76 may be shorter in length than the slots 44 to permit longitudinal movement of the linear cam 26 relative to the housing 20. The difference in length between the ribs 76 and the slots 44 may substantially correspond to the longitudinal distance D1 between the rounded peak 68*c* of the cam surface 68 and the associated end 62*b* of the body 58 of the rotary cam 24 (FIG. 5D). Additionally or alternatively, the linear cam 26 may be non-rotatable relative to the housing 20. For example, the ribs 76 may have substantially equal widths to the slots 44 to substantially prevent rotation of the linear cam 26 relative to the housing 20 (see FIG. 7A). Although a pair of ribs 76 is depicted in FIGS. 6A-6B, more or less ribs 76 may be provided.

With continued reference to FIGS. 6A-6B, a cam surface 78 may be formed into an end 74*a* of the body 70 of the linear cam 26 and may define a transversely-extending groove 80. The cam surface 78 may include opposing sloped surfaces 78*a*, 78*b* that recess into the body 70 from one end 74*a* of the linear cam 26 toward an opposing end 74*b*. The sloped surfaces 78*a*, 78*b* may converge together as the surfaces 78*a*, 78*b* extend toward the opposing end 74*b* of the body 70 and may intersect at a transversely-extending trough 78*c*, which may be rounded. The sloped surfaces 78*a*, 78*b* of the linear cam 26 and the sloped surfaces 68*a*, 68*b* of the rotary cam 24 may be formed at supplementary angles relative to one another.

With reference back to FIGS. 2A-3B, the linear cam 26 may be positioned within the cavity 41*c* of the housing 20 and may be slidable relative to the housing 20 along the longitudinal axis 30 of the louver closure device 18. The substantially cylindrical outer wall 72 of the linear cam 26 may be substantially congruent with and may slidably bear against the inner wall 40*c* of the housing 20. The end 74*a* of the linear cam 26 associated with the cam surface 78 may confront the end 62*b* of the rotary cam 24 associated with the cam surface 68. The opposite end 74*b* of the linear cam 26 may contact the compression spring 28, which may be longitudinally positioned between the linear cam 26 and an inner end wall or abutment shoulder 42*c* of housing 20 (see FIGS. 2B-3B). Biasing elements other than a compression spring 28 may be used. For example, the biasing element may be other types of springs, a fluid, or other suitable resilient energy storage devices.

Figure 7A:
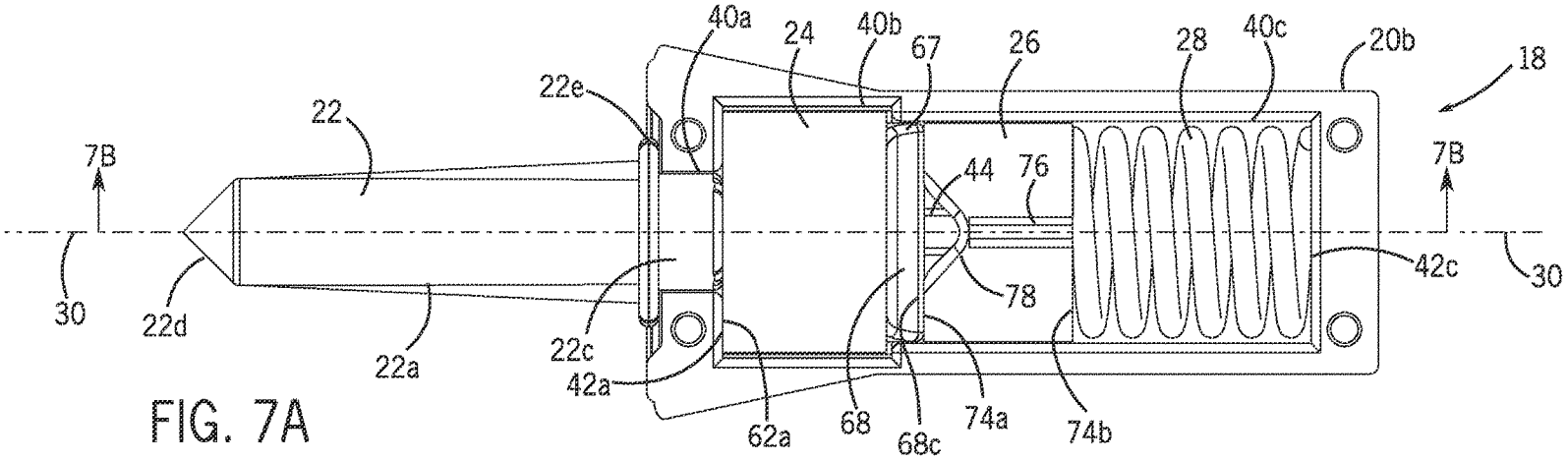
FIG. 7A is a top plan view of the louver closure assembly of FIGS. 2A-2C in a first position, which may correspond to a fully-opened louver position. One-half of the housing is removed for clarity purposes.
Figure 7B:
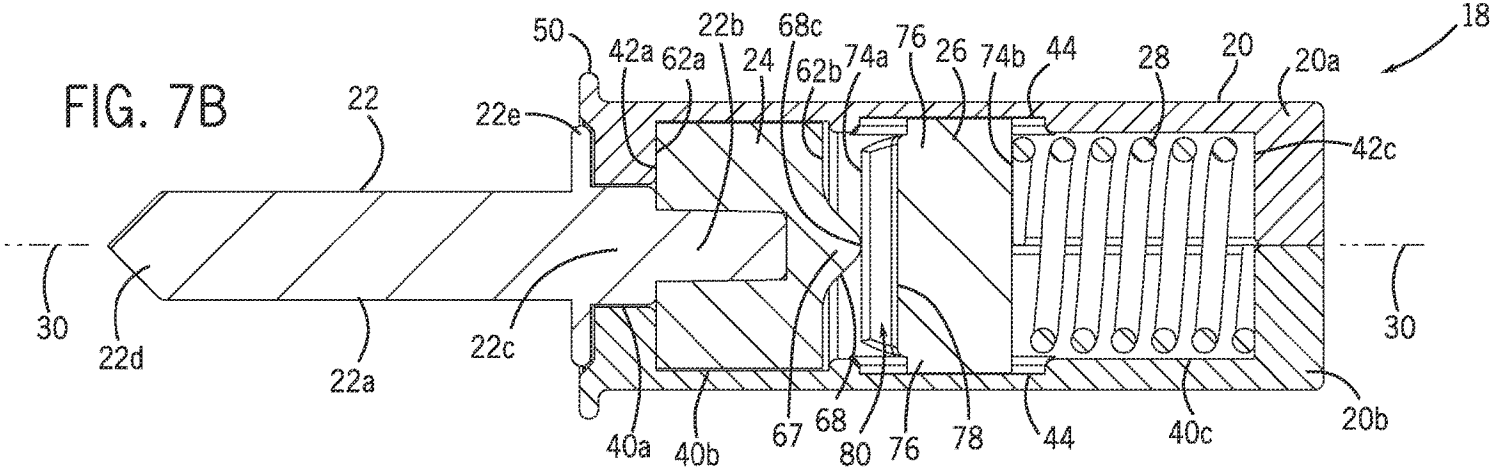
FIG. 7B is a longitudinal cross-sectional view of the louver closure assembly of FIGS. 2A-2C taken along the line 7B-7B illustrated in FIG. 7A.
Figure 10:
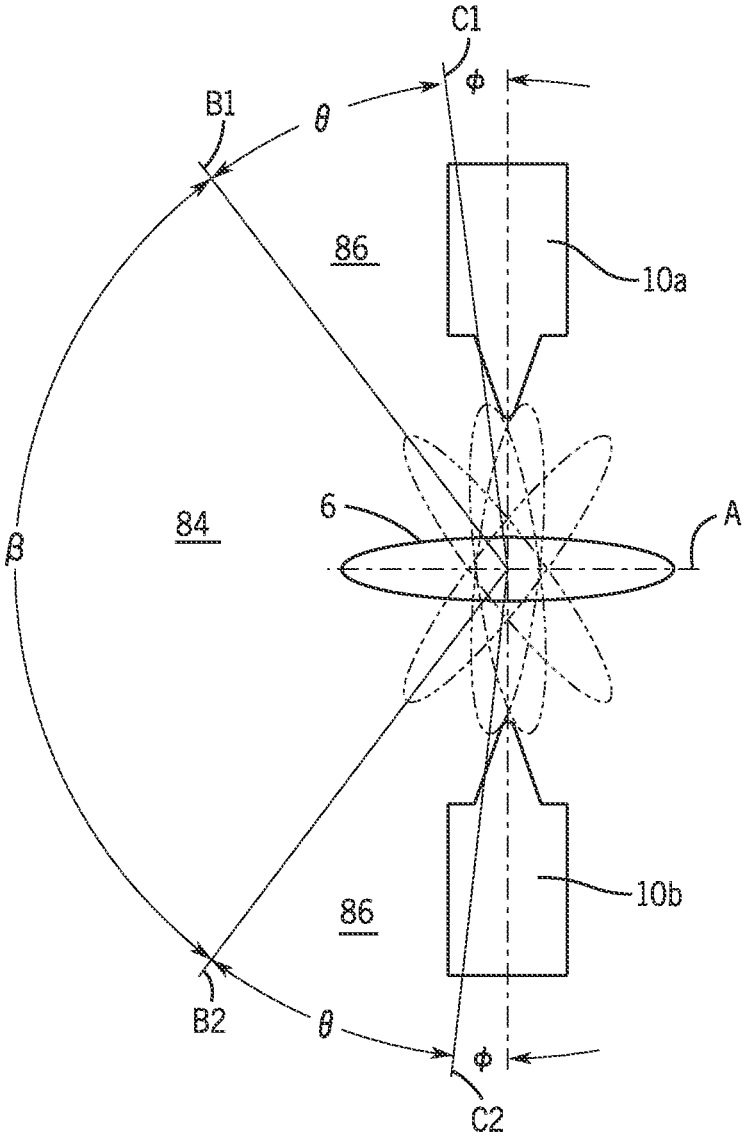
FIG. 10 is a transverse cross-sectional view of a louver of the louvered shutter of FIG. 1B taken along the line 10-10 illustrated in FIG. 1B. The louver is illustrated in a fully-opened position, a partially-opened position, and a fully-closed position.

With reference to FIGS. 7A and 7B, the louver closure device 18 is depicted in a first position, which may correspond to a fully-opened louver position (position A in FIG. 10). In the first position, the rotary cam 24 and the linear cam 26 may be oriented relative to one another so that the protuberance 67 of the rotary cam 24 is oriented substantially orthogonal to the groove 80 formed in the linear cam 26. The peak 68*c* of the cam surface 68 of the rotary cam 24 may abut or contact a confronting end 74*a* of the linear cam 26. An opposing end 62*a* of the rotary cam 24 may abut or contact a confronting shoulder 42*a* of the housing 20.

The louver closure device 18 may be configured to provide a consistent holding force that maintains the louvers 6 in a desired position. With continued reference to FIGS. 7A and 7B, the compression spring 28 may be positioned between one end 74*b* of the linear cam 26 and an opposing wall 42*c* of the housing 20. The compression spring 28 may exert an axial force on the linear cam 26, which may result in a compressive force being applied to the rotary cam 24. The compressive force may be created by the end 74*a* of the linear cam 26 applying an axial force on the protuberance 67 of the cam surface 68 and the shoulder 42*a* of the housing 20 applying an axial, reactionary force on an opposite end 62*a* of the rotary cam 24.

The compressive force exerted on the rotary cam 24 may generate a resistive friction force that generally opposes relative rotational movement between the rotary cam 24 (and thus the louver pin 22) and the housing 20. In this manner, the louver closure device 18 may counteract gravitational forces applied to the louver 6 and generally resist louver movement. The magnitude of the resistive friction force may be increased or decreased by altering a coefficient of friction between the contacting surfaces (such as by altering materials, surface finish, or the like), by altering a spring force exerted by the compression spring 28, or both. The spring 28 may be selected from an assortment of springs based on the specific louver panel application.

Once a torque sufficient to overcome the resistive friction force of the louver closure device 18 is applied to the louver pin 22 or the housing 20, the rotary cam 24 and the louver pin 22 may rotate relative to the housing 20 and the linear cam 26, or vice versa. During the relative rotation between the rotary cam 24 and the linear cam 26, the transversely-extending peak 68*c* of the cam surface 68 may rotatably bear against the confronting end 74*a* of the linear cam 26. The relative rotation between the rotary cam 24 and the linear cam 26 may cause the relative angle between the protuberance 67 and the groove 80 to decrease from substantially perpendicular to an acute angle. With reference to FIG. 10, this relative rotation between the rotary cam 24 and the linear cam 26 may correspond to the louver 6 moving from position A toward position B1 or position B2. At substantially any point during this rotation, the user-initiated force may be ceased and the resistive friction force or tension in one or more louver devices may maintain the orientation of the louver 6 until further louver movement is initiated by the user.

Figure 8A:
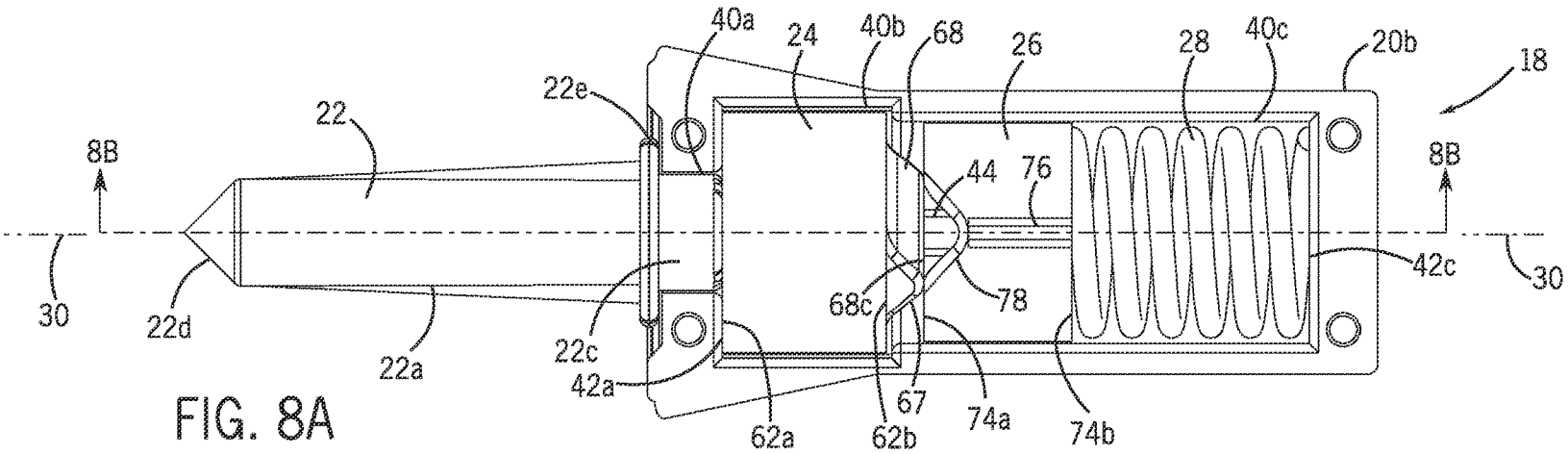
FIG. 8A is a top plan view of the louver closure assembly of FIGS. 2A-2C in a second position, which may correspond to a partially-opened louver position. One-half of the housing is removed for clarity purposes.
Figure 8B:
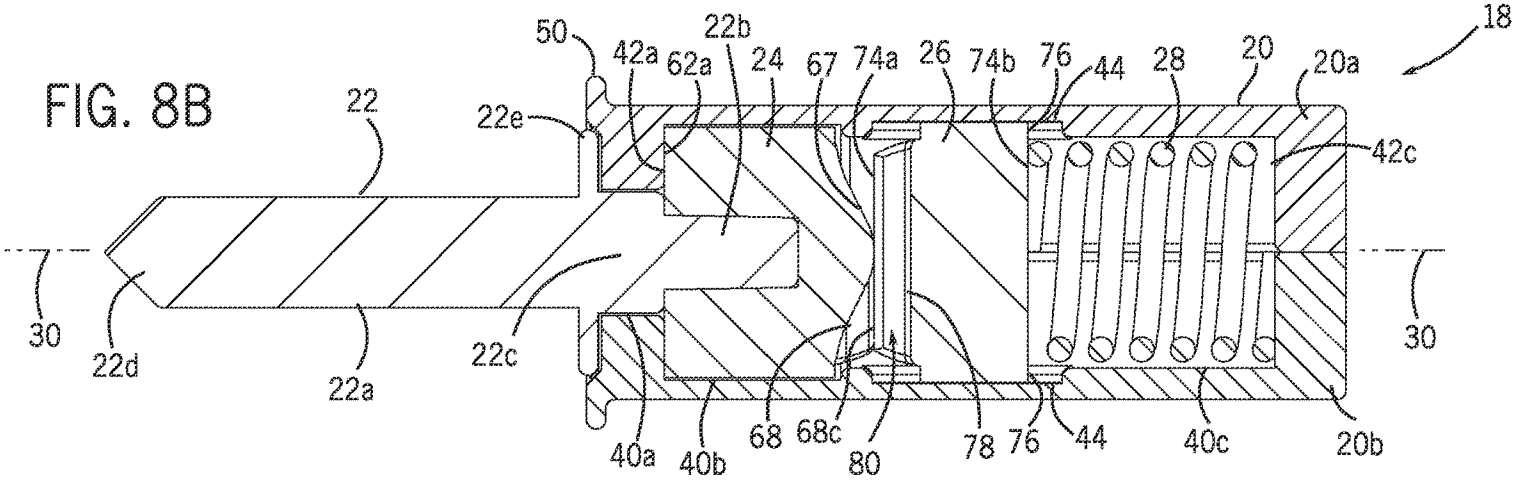
FIG. 8B is a longitudinal cross-sectional view of the louver closure assembly of FIGS. 2A-2C taken along the line 8B-8B illustrated in FIG. 8A.
Figure 9A:
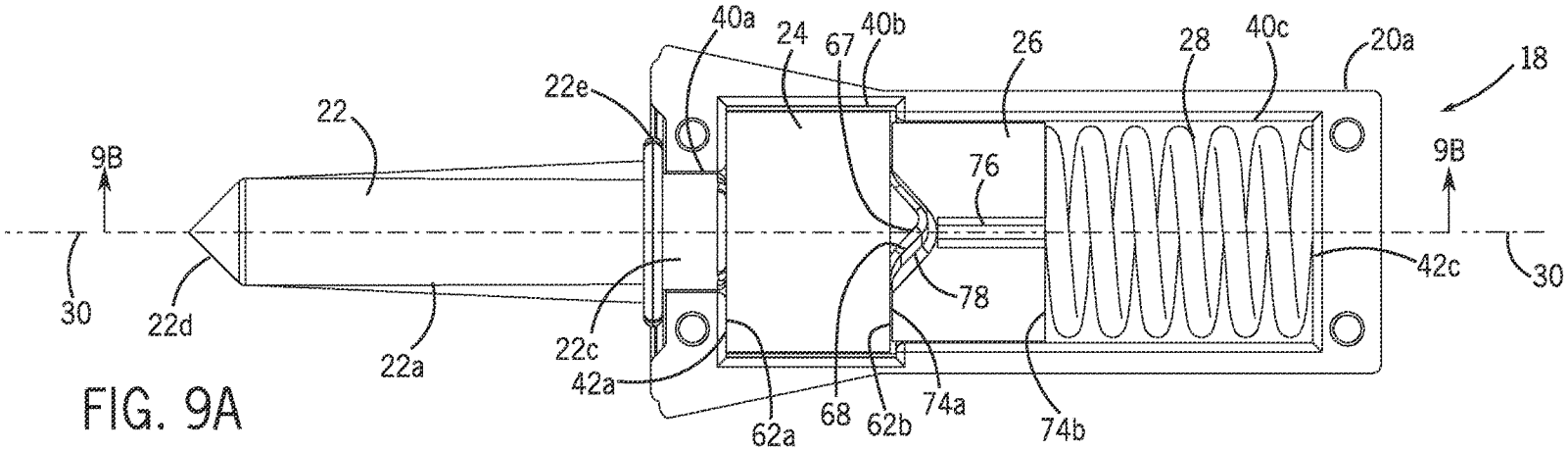
FIG. 9A is a top plan view of the louver closure assembly of FIGS. 2A-2C in a third position, which may correspond to a fully-closed louver position. One-half of the housing is removed for clarity purposes.
Figure 9B:
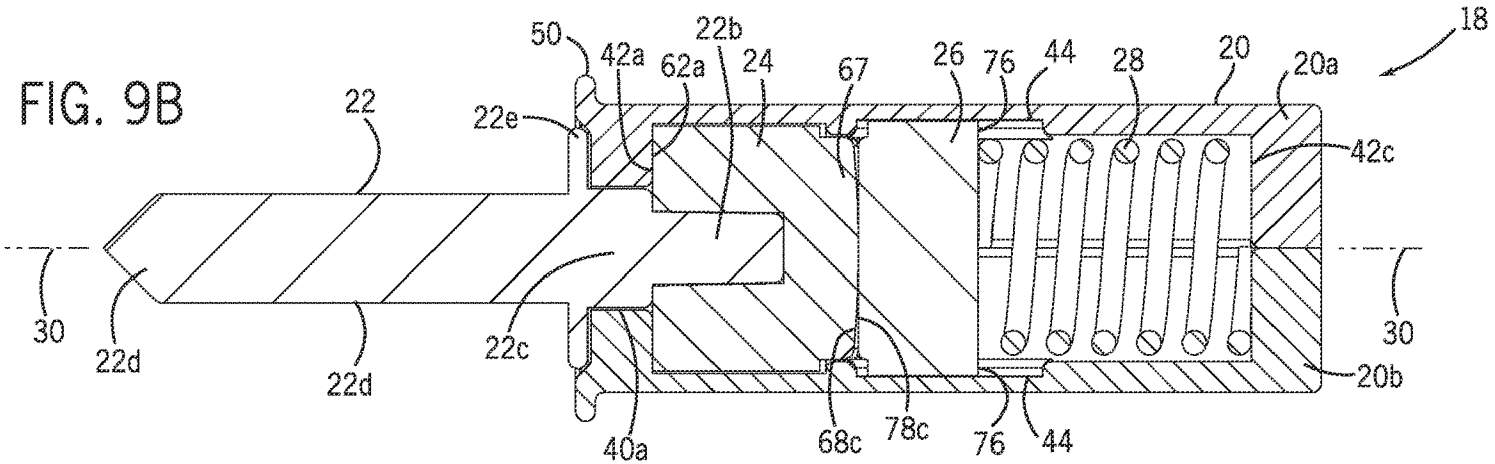
FIG. 9B is a longitudinal cross-sectional view of the louver closure assembly of FIGS. 2A-2C taken along the line 9B-9B illustrated in FIG. 9A.

With reference to FIGS. 8A-8B, the louver closure device 18 is depicted in a second position, which may correspond to a partially-opened louver position (position B1 or B2 in FIG. 10). In the second position, the transversely-extending peak 68*c* of the protuberance 67 may span the groove 80 formed in the linear cam 26 and contact the end 74*a* of the linear cam 26 immediately adjacent opposing corners of the groove 80. Further rotation of an associated louver 6 in a closing direction may cause the opposing ends of the cam surface 68 to contact the opposing sloped surfaces 78*a*, 78*b* of the cam surface 78. Once the protuberance 67 begins to enter the groove 80, the compression spring 28 may slide the linear cam 26 axially relative to the housing 20 toward the rotatable, substantially non-slidable rotary cam 24, which may cause the rotary cam 24 to rotate until the protuberance 67 is at least partially seated within the groove 80 (FIGS. 9A-9B). Generally, the interface of the protuberance 67 with the sloped side walls of the groove 80 may cause the rotary and linear cams 24, 26 to substantially align with one another with the protuberance 67 being at least partially seated in the groove 80. As the louver pin 22 may be non-rotatably coupled to the rotary cam 24, the cam-driven rotation of the rotary cam 24 may cause the louver pin 22 to rotate in the closed direction, thereby rotating a directly associated louver 6 toward a fully-closed position. As each louver 6 in a shutter panel 2 may be interconnected to every other louver 6 in the shutter panel 2, the rotation of the directly associated louver 6 may cause every louver 6 in the shutter panel 2 to similarly rotate toward a fully-closed position.

With reference to FIGS. 9A-9B, the louver closure device 18 is depicted in a third position, which may correspond to a fully-closed louver position (position C1 or C2 in FIG. 10). In the third position, the protuberance 67 of the rotary cam 24 may be at least partially seated within the groove 80 of the linear cam 26. The peak 68*c* of the cam surface 68 of the rotary cam 24 may be rotationally offset from the trough 78*c* of the cam surface 78 by an angle $\phi$ (see FIG. 10), which may correspond to an angular offset of the closed louvers 6 from a reference axis (such as a vertical axis), which is further discussed below. In this third position, the compression spring 28 may apply an axial force to the linear cam 26 that biases the rotary cam 24 toward a fully seated position relative to the linear cam 26. Thus, the louver closure device 18 may apply a continuous force to an associated closed louver 6 that may maintain the louver 6 in the fully-closed position until an opening force is applied to the louver 6. As each louver 6 in a shutter panel 2 may be interconnected to every other louver 6 in the shutter panel 2, the louver closure device 18 may maintain multiple louvers 6 in the shutter panel 2 in a fully-closed position. To move the louvers 6 from the fully-closed position into an open position, a user-initiated force that is sufficient to overcome the biasing force of the louver closure device 18 may be applied to the louvers 6 (such as by a tilt bar, a gear track system, a pulley system, or another suitable drive system).

With reference to FIG. 10, a single louver 6 is depicted in relation to an upper rail 10*a* and a lower rail 10*b* (for clarity purposes only one louver 6 is depicted, although multiple louvers 6 may operate in the same fashion with adjacent louvers 6 contacting each other substantially simultaneously). The louver 6 may be in a fully-opened position when oriented in position A, which as previously discussed may correspond to the louver closure device 18 configuration depicted in FIGS. 7A and 7B. Rotating the louver 6 upward or downward toward the upper rail 10*a* or the lower rail 10*b* may rotate the louver within a non-automatic closure angular range 84, which may have an angle $\beta$. When the louver 6 is positioned within the non-automatic closure angular range 84, the louver closure device 18 may maintain the louver 6 in a desired orientation and a user-initiated force may be required to rotate the louver 6 into a different orientation.

Once the louver 6 is rotated to or beyond the angular position B1 or B2, the louver 6 may enter into an automatic or cam-driven closure range 86, which may correspond to the louver closure device 18 configuration depicted in FIGS. 8A and 8B. When the louver 6 is positioned within the self-closure range 86, which may have an angular range $\theta$, the louver closure device 18 may drive or rotate the louver 6 into a fully-closed position. The louver closure device 18 may move the louver 6 into the closed position without user interaction.

The angles $\beta$ and $\theta$ may be altered based on different applications, user preferences, and many other factors. For example, the corresponding cam features 67, 80 of the rotary and linear cams 24, 26 may be altered to change the closure angles. With reference to FIGS. 6A-6B, the angles $\beta$ and $\theta$ may be altered by changing the width W of the entrance to the groove 80. By increasing the width W of the groove 80, the angle $\beta$ may decrease and the angle $\theta$ may increase. By decreasing the width W of the groove 80, the angle $\beta$ may increase and the angle $\theta$ may decrease. In some implementations, the angle $\beta$ is between about 120 degrees and about 160 degrees, and the angle $\theta$ is between about 5 degrees and about 25 degrees. In one implementation, the angle $\beta$ is about 140 degrees and the angle $\theta$ is about 15 degrees.

Once the louver 6 is oriented into the fully-closed angular position C1 or C2, which as previously discussed may correspond to the louver closure device 18 depicted in FIGS. 9A and 9B, the louver 6 may be maintained in this orientation until a user-initiated force rotates the louver 6 from the closed position toward an open position. When the louver 6 is positioned in the fully-closed angular position C1 or C2, the louver 6 may be offset from a plane that bisects the upper and lower rails 10*a*, 10*b* by an angle $\phi$, which may vary depending on the shutter panel 2. In some implementations, the angle $\phi$ is between about 6 degrees and about 8 degrees. As previously discussed, the louver closure device 18 may provide a closure range that includes the stop offset angle $\phi$. That is, the louver closure device 18 may provide a closure range of angle $\theta$ plus angle $\phi$ in relation to either or both ends of travel of a louver 6. Thus, the effective closure range of a louver 6 may be represented as the self-closure range 86 having an angular range of $\theta$.

Generally, the corresponding cam features may generate a rotational force when substantially aligned with one another. The profiles of the cam surface 68 and the cam surface 78 may be switched without effecting the operation of the louver closure device 18. That is, in one implementation, the cam surface 68 is recessed into an end 62*b* of the body 58 of the rotary cam 24 and the cam surface 78 protrudes from a confronting end 74*a* of the body 70 of the linear cam 26.

The automatic or self-closure of the louvers 6 may be advantageous in view of conventional shutters, which may experience inconsistent or uneven louver closure due at least in part to component tolerances designed to prevent binding. For example, when a force is applied near an end of a conventional shutter panel, some of the louver motion caused by the force may not be transferred through the shutter panel as the component tolerances may absorb some of the motion. Thus, louvers near an opposite end of the panel may not travel as far as the louvers near the force application point. The varying amount of louver travel through the shutter panel may result in inconsistent or uneven louver closure. In some circumstances, the inconsistent or uneven louver closure may permit undesired light passage through the shutter panel, despite a user applying a force to the shutter panel to close the shutters. By including at least one louver closure device 18 in a shutter panel 2, the louvers 6 in the shutter panel 2 may automatically close into a fully closed position and may remain in that position until an opening force is applied to the louvers 6. Multiple louver pin cam assemblies 18 may be used in some shutter panels and may be dispersed through the shutter panel to ensure consistent and reliable louver closure. The automatic closure angle of the louver closure assembly may be altered based on user preferences.

Figure 11:
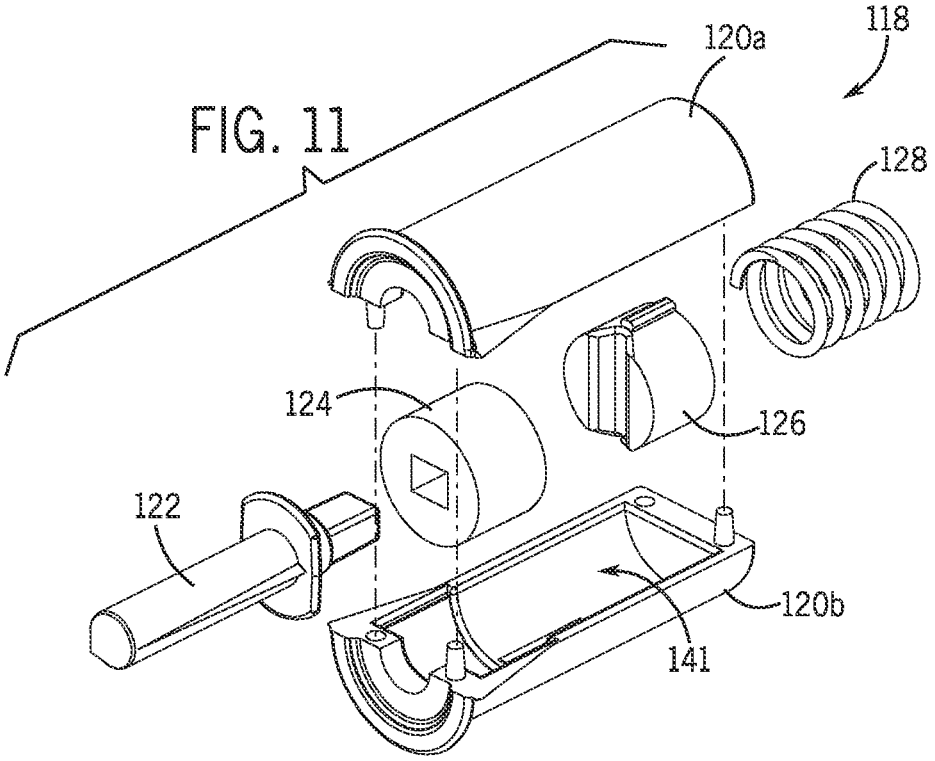
FIG. 11 is an exploded, isometric view of a louver tension assembly.
Figure 12A:
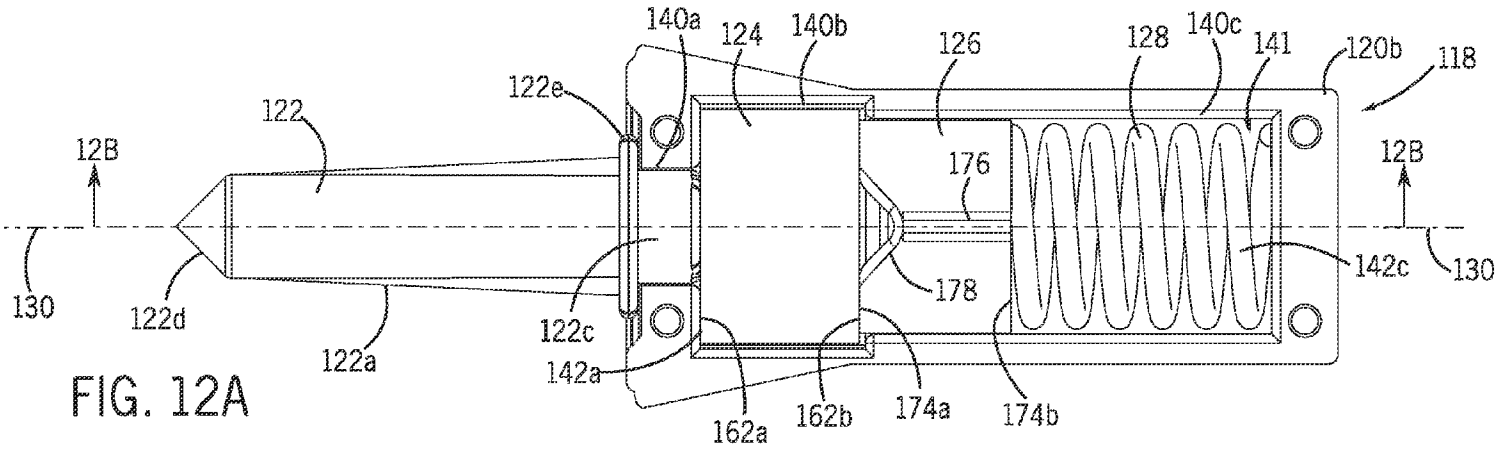
FIG. 12A is a top plan view of the louver tension assembly of FIG. 11 with one-half of the housing removed for clarity purposes.
Figure 12B:
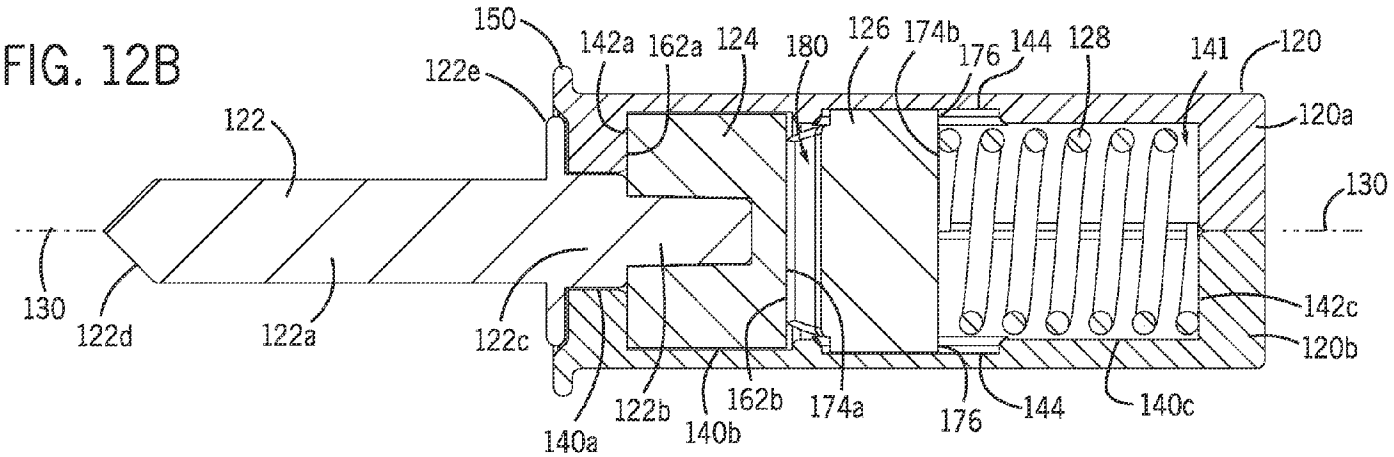
FIG. 12B is a longitudinal cross-sectional view of the louver tension assembly of FIG. 11 taken along the line 12B-12B illustrated in FIG. 12A.

With reference to FIGS. 11-12B, a louver tension device 118 is provided. With the exception of the rotary cam 124 not including a protuberance 67, the louver tension device 118 generally has the same features as the louver closure device 18. Accordingly, the preceding discussion of the housing 20, the louver pin 22, the rotary cam 24, the linear cam 26, and the compression spring 28 should be considered equally applicable to the louver tension device 118, except as noted in the following discussion. The reference numerals used in FIGS. 11-12B generally correspond to the reference numbers used in FIGS. 1-10 to reflect the similar parts and components, except the reference numerals are incremented by one hundred.

With continued reference to FIGS. 11-12B, the louver tension device 118 may include a housing 120, a louver pin 122, a rotary cam 124, a linear cam 126, and a spring 128. The housing 120, the louver pin 122, the rotary cam 124, the linear cam 126, and the spring 128 may be aligned along a longitudinal axis 130 of the louver tension device 118. The louver pin 122 may be rotatably mounted to the housing 120 such that a first keyed portion 122*a* protrudes from the housing 120 along the longitudinal axis 130 of the louver tension device 118 and a second keyed portion 122*b* extends into an inner cavity 141 defined by the housing 120. The rotary cam 124, the linear cam 126, and the spring 128 may be positioned within the housing 120, with the linear cam 126 positioned intermediate the rotary cam 124 and the spring 128 along the longitudinal axis 130. The rotary cam 124 may be positioned within the cavity 141 and may be non-rotatably coupled to the louver pin 122. The linear cam 126 may be positioned within the cavity 141 immediately adjacent the rotary cam 124 and may be biased into contact with the rotary cam 124 by a compression spring 128 or many other suitable biasing elements.

The louver tension device 118 may be configured to provide a consistent holding force that maintains the louver 6 in a desired position. With continued reference to FIGS. 11-12B, the compression spring 128 may be positioned between one end 174*b* of the linear cam 126 and an opposing wall 142*c* of the housing 120. The compression spring 128 may exert an axial force on the linear cam 126, which may result in a compressive force being applied to the rotary cam 124. The compressive force may be created by the end 174*a* of the linear cam 126 applying an axial force on a confronting end 162*b* of the rotary cam 124, and the shoulder 142*a* of the housing 120 applying an axial, reactionary force on an opposite end 162*a* of the rotary cam 124.

The compressive force exerted on the rotary cam 124 may generate a resistive friction force that generally opposes relative rotational movement between the rotary cam 124 (and thus the louver pin 122) and the housing 120. In this manner, the louver tension device 118 may counteract gravitational forces applied to the louvers 6 and generally resist louver movement. The magnitude of the resistive friction force may be increased or decreased by altering a coefficient of friction between the contacting surfaces (such as by altering materials, surface finish, or the like), by altering a spring force exerted by the compression spring 128, or both. The spring 128 may be selected from an assortment of springs based on a specific shutter panel application.

Each louver tension device 118 may be configured to restrain or inhibit rotation of at least a portion of one louver 6 until a user-initiated force is applied to the louver 6. For example, a single louver tension device 118 may resist rotation of a portion of the louvers 6 in a given shutter panel 2 so that multiple louver pin tension assemblies 118 may collectively maintain all of the shutter panel louvers in a given position. As another example, a single louver tension device 118 may resist rotation of all louvers 6 in a given shutter panel 2 so that a single louver tension device 118 may individually maintain all of the shutter panel louvers in a given position.

Once a torque sufficient to overcome the resistive friction force of the louver tension device 118 is applied to the louver pin 122 or the housing 120, the rotary cam 124 and the louver pin 122 may rotate relative to the housing 120 and the linear cam 126, or vice versa. During the relative rotation between the rotary cam 124 and the linear cam 126, one end 162*b* of the rotary cam 124 may rotatably bear against the confronting end 174*a* of the linear cam 126. At substantially any point during this rotation, the user-initiated force may be ceased and the resistive friction force or tension in one or more louver tension assemblies 118 may maintain the orientation of the louver 6 until further louver movement is initiated by the user. As the rotary cam 124 does not include the protuberance 67, the contact area between the rotary cam 124 and the linear cam 126 is generally increased in the louver tension device 118 compared to the louver closure device 18. As such, the louver tension device 118 may provide a larger resistive friction force relative to the louver closure device 18. Although the linear cam 126 is depicted with a groove 180 formed in a rotary-cam-confronting end 174*a* of the linear cam 126, in some implementations the linear cam 126 does not include the groove 180 and the rotary-cam-confronting end 174*a* of the linear cam 126 may be substantially continuous.

The louver tension device 118 may provide advantages relative to conventional louver tension pins. For example, the louver tension device 118 may provide substantially consistent frictional resistance or tension to the shutter panel regardless of a fit or tolerance between an inner wall of a receiving hole and an outer wall of the housing 120. In various implementations, the resistive frictional force generated between the confronting end faces of the rotary cam 124 and the linear cam 126 may be substantially unaffected by the fit or tolerance of the housing 120 and an inner wall of a receiving hole. That is, the louver tension device 118 may resist louver rotation with a substantially consistent force regardless of tolerance variations between the louver tension device 118 and a corresponding structure of the shutter panel 2.

Figure 13:
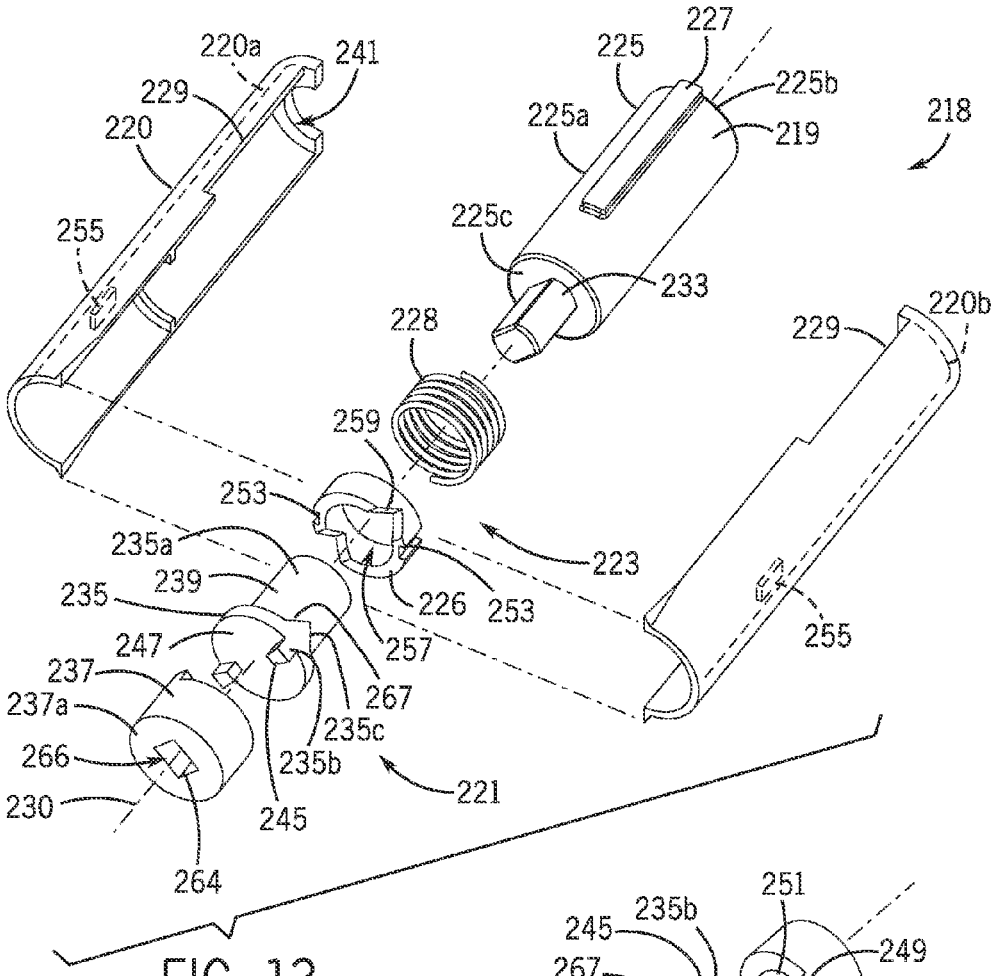
FIG. 13 is an exploded, isometric view of a louver damping assembly.
Figure 14:
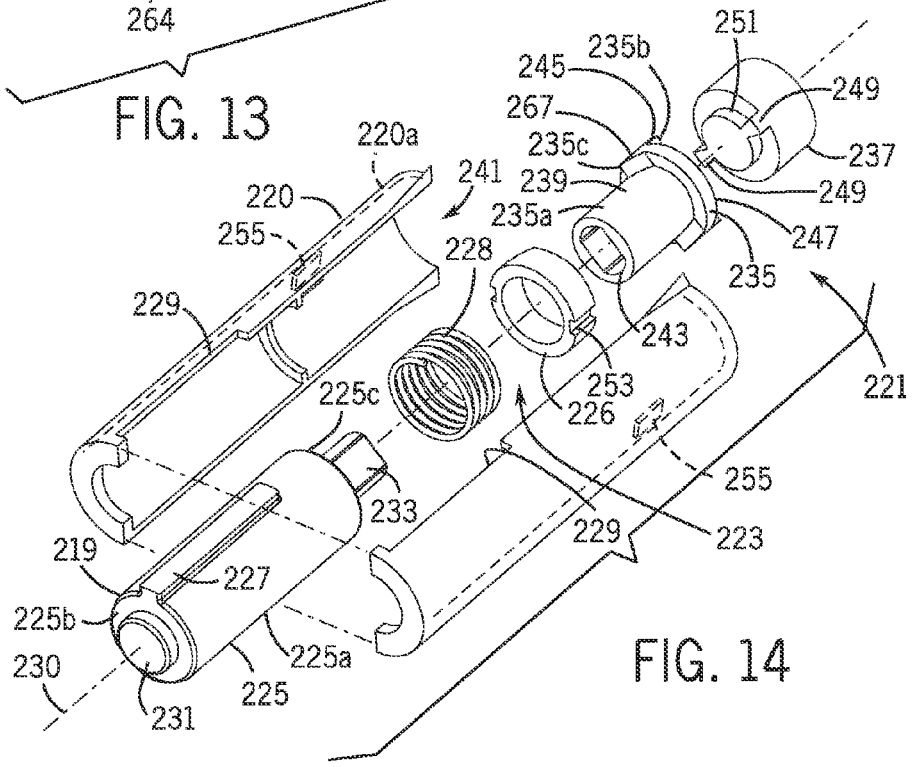
FIG. 14 is another exploded, isometric view of the louver damping assembly of FIG. 13.
Figure 15:
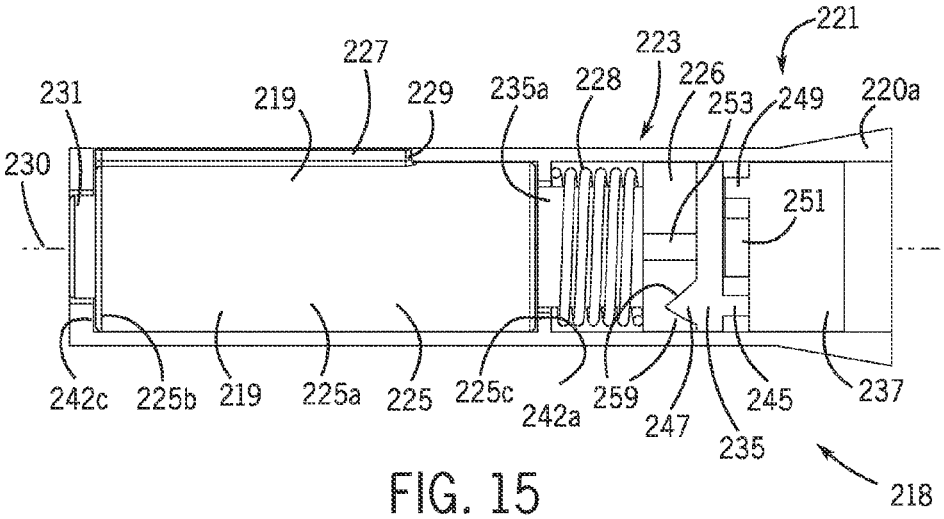
FIG. 15 is a top plan view of the louver damping assembly of FIG. 13.

With reference to FIGS. 13-15, a louver damping device 218 is provided. The louver damper assembly 218 may include a damper 219, a deadband system 221, a centering system 223, and a housing 220. The damper 219, the deadband system 221, and the centering system 223 may be received within an internal cavity 241 of the housing 220 and may be aligned along a longitudinal axis 230 of the louver damping device 218.

The damper 219 may be a rotary damper and may include a barrel or outer wall 225 that is non-rotatably keyed to the housing 220 to substantially prevent relative rotation between the outer wall 225 of the damper 219 and the housing 220. As illustrated in FIGS. 13-15, a longitudinally-extending spline 227 may protrude radially outward from a substantially cylindrical section 225*a* of the outer wall 225 of the damper 219 and may be received within a corresponding longitudinally-extending slit 229 formed in the housing 220, although other corresponding keyed structures may be used. In one implementation, one-half of the slit 229 is defined by a first housing member 220*a* and the other half of the slit 229 is defined by a second housing member 220*b* to ease positioning of the spline 227 within the slit 229 during assembly.

With continued reference to FIGS. 13-15, the substantially cylindrical section 225*a* of the damper 219 may terminate at opposing, transversely-oriented ends 225*b*, 225*c*. One of the ends 225*b* of the outer wall 225 of the damper 219 may abut against a shoulder 242*c* of the housing 220 and the other of the ends 225*c* of the outer wall 225 of the damper 219 may abut against an opposing shoulder 242*a* of the housing 220 to substantially axially restrain the damper 219 within the housing 220. A boss 231 may extend longitudinally away from one end 225*b* of the outer wall 225 and may extend beyond the shoulder 242*c* of the housing 220 to reduce the longitudinal envelope of the louver damping device 218. An operative shaft 233 of the damper 219 may extend longitudinally away from the other end 225*c* of the outer wall 225.

In some implementations, a rotary damper manufactured by Nifco Inc. may be used. In one implementation, a small axis damper manufactured by Nifco Inc. (for example, part number 3F7W or 3F7X) may be used. The torque specification of the damper may vary depending on the shutter panel application. In one implementation, the damper torque may be about 5 Ncm, about 10 Ncm, or any other suitable torque level based on the shutter panel application.

The deadband system 221 may be non-rotatably keyed to the shaft 233 of the damper 219 to selectively transfer torque from an associated louver 6 to the damper 219 based upon a rotational orientation of the louver 6. The deadband system 221 may include a damper adapter 235 and a louver pin adapter 237. The damper adapter 235 may be positioned intermediate the louver pin adapter 237 and the damper 219 along the longitudinal axis 230 of the louver damping device 218.

With continued reference to FIGS. 13-15, the damper adapter 235 may be keyed to the damper 219 and selectively transfer torque between the louver pin adapter 237 and the damper 219. The damper adapter 235 may include a damper interface portion 235*a*, a louver pin adapter interface portion 235*b*, and a centering system interface portion 235*c*. The damper interface portion 235*a* may be associated with one end of the damper adapter 235. The damper interface portion 235*a* may be formed as a sleeve having a substantially cylindrical outer wall 239 and a keyed inner wall 243 corresponding in shape to an outer surface of the operative shaft 233 of the damper 219. When the louver damping device 218 is assembled, the damper interface portion 235*a* may at least partially surround the operative shaft 233 of the damper 219.

The louver pin adapter interface portion 235*b* of the damper adapter 235 may be associated with an opposing end of the damper adapter 235 relative to the damper interface portion 235*a*. The louver pin adapter interface portion 235*b* may include two diametrically opposed tangs 245. The tangs 245 may protrude axially from a substantially flat end face 247 of the louver pin adapter 237. When the louver damping device 218 is assembled, the tangs 245 may selectively interact with the louver pin adapter 237, which is discussed in more detail later in this disclosure.

The centering system interface portion 235*c* of the damper adapter 235 may be positioned intermediate the damper interface portion 235*a* and the louver pin adapter interface portion 235*b*. The centering system interface portion 235*c* may include a cam actuator 267 extending axially in a direction away from the tangs 245 toward the damper 219. The cam actuator 267 may be formed as a wedge, as illustrated in FIGS. 13-15. When the louver damping device 218 is assembled, the cam actuator 267 may interact with the centering system 223, which is discussed in more detail later in this disclosure.

With continued reference to FIGS. 13-15, the louver pin adapter 237 may be non-rotatably keyed to the louver pin 22 (see FIGS. 2A-2C) to selectively transfer torque between the louver pin 22 and the damper adapter 235. The second keyed portion 22*b* of the louver pin 22 may be received within a receptacle 266 defined by an internal wall 264 of the louver pin adapter 237. The receptacle 266 may open through one end 237*a* of the louver pin adapter 237. In some implementations, the louver pin adapter 237 may be integrally formed with the louver pin 22.

The louver pin adapter 237 may include two wings 249 extending radially outward from a substantially cylindrical bearing surface 251. The wings 249 and the substantially cylindrical bearing surface 251 may protrude longitudinally from an end 237*b* of the louver pin adapter 237. When the louver damping device 218 is assembled, the tangs 245 of the damper adapter 235 may rotatably bear against the substantially cylindrical bearing surface 251 of the louver pin adapter 237 to maintain an axial alignment between the damper adapter 235 and the louver pin adapter 237. Additionally, the tangs 245 of the damper adapter 235 may be positioned within a rotational path of the wings 249 of the louver pin adapter 249 to selectively transfer torque from the louver pin adapter 237 through the damper adapter 235 to the damper 219.

Within continued reference to FIGS. 13-15, the centering system 223 of the louver damping device 218 may include a linear cam 226 and a helically-wound compression spring 228. The linear cam 226 may include one or more longitudinally-extending slots 253 formed in an outer surface of the linear cam 226 that may slidably receive one or more longitudinally-extending, radially inward directed ribs 255 of the housing 220. As such, the linear cam 226 may be slidable, but substantially non-rotatable, relative to the housing 220. The linear cam 226 also may include a substantially v-shaped groove 257 recessed into one end of the linear cam 226 and defined by opposing sidewalls 259. The mouth or width of the groove 257 may be larger than the width W of the groove 80 of the linear cam 26 (see FIGS. 6A-6B) so that the cam actuator 267 remains at least partially seated within the groove 257 during closure of the louver 6. When the louver damping device 218 is assembled, the cam actuator 267 of the damper adapter 235 may be seated within the groove 257 of the linear cam 226 (FIG. 15). Additionally, the compression spring 228 may be positioned between the linear cam 226 and a confronting end 225*c* of the damper 219. The compression spring may bias the cam actuator 267 into the seated position.

With continued reference to FIGS. 13-15, the operation of the louver damping device 218 is discussed in relation to a shutter panel 2 including a louver closure device 18 for clarity purposes. As the louver pin adapter 237 may be linked to a louver 6 through a louver pin 22, the louver pin adapter 237 may rotate in unison with the louver 6. Thus, as the louver 6 is rotated, the louver pin adapter 237 may rotate in the same general direction as the louver 6. Similar to the corresponding cam features of the rotary cam 24 and the linear cam 26 of the louver closure device 18, the wings 249 of the louver pin adapter 237 and the tangs 245 of the damper adapter 235 may be rotationally misaligned by about 90 degrees when the louver 6 is in a fully-opened position. From this fully-opened position, rotation of the louver 6 toward a closed position may rotate the louver pin adapter 237 relative to the damper adapter 235, thereby moving the wings 249 of the louver pin adapter 237 toward the tangs 245 of the damper adapter 235.

Once the wings 249 of the louver pin adapter 237 contact the tangs 245 of the damper adapter 235, further rotation of the louver 6 in a closing direction (which may be driven by the louver closure device 18) may be transferred to the damper 219 through the keyed engagement of the damper adapter 235 and the shaft 233 of the damper 219. That is, rotational alignment of the wings 249 and the tangs 245 may result in damper engagement. Once engaged, the damper 219 may resist further rotation of the louver 6 in a closing direction. The radial width of the wings 249 and the tangs 245 may be configured such that the wings 249 contact or engage the tangs 245, thereby actuating the damper 219, substantially simultaneously with the actuation of the louver closure device 18. The damping rate of the damper 219 may restrain the closing force of the louver closure device 18 and provide a generally controlled, consistent, slow, and/or smooth closure. As such, the damping rate of the damper 219 may control or govern the rate of closure of the louver 6. The actuation of the louver damping device 218 may be altered by changing the radial width of the tangs 245, the wings 249, or both.

As the damper adapter 235 is rotated by the louver pin adapter 237 during closure of the louver 6, the damper adapter 235 may rotate relative to the linear cam 226, which may be positioned around the outer wall 239 of the sleeve portion 235*a* of the damper adapter 235. The relative rotation between the damper adapter 235 and the linear cam 226 may cause the cam actuator 267 to contact a sidewall 259 of the groove 257 and drive the linear cam 226 toward the damper 219 against the spring force of the compression spring 228. When the louver 6 is in a fully closed position, the louver closure device 18 may hold the louver 6 in the fully closed position, thereby maintaining the cam actuator 267 in engagement with the sidewall 259 of the groove 257 (the spring force of the compression spring 28 of the louver closure device 18 is larger than the spring force of the compression spring 228).

To open the louver 6 from the fully-closed position, an opening force that exceeds the closing force of the louver closure device 18 may be applied to the louver 6. As the louver 6 is opened, the louver pin adapter 237 may rotate in unison with the louver 6. Also, the compression spring 228 of the louver damping device 218 may slide the linear cam 226 away from the damper 219 toward the louver pin adapter 237, which may cause the sidewall 259 of the groove 257 to apply a lateral force to the cam actuator 267 of the damper adapter 235, which may rotate the damper adapter 235 (and thus the damper 219) into its initial position that may correspond to a fully-opened louver position. In this position, the cam actuator 267 may be seated in the groove 257 and the tangs 245 may be rotated into their pre-engagement position relative to the wings 249 of the louver pin adapter 237.

The louver damping device 218 may provide a generally controlled, consistent, slow, and/or smooth closure of the louver 6. The deadband system 221 of the louver damping device 218 may provide a first angular range in which the damper 219 is disengaged from the louver 6 and a second angular range in which the damper 219 resists rotation of the louver 6. The centering system 223 of the louver damping device 218 may re-align or re-center at least some of the components of the louver damping device 218 (which may include the damper 219) in preparation for subsequent louver closure.

By including a louver closure device 18 and a louver damping device 218 in a shutter panel 2, the louvers 6 in the shutter panel 2 may automatically close in a generally controlled, consistent, slow, and/or smooth manner into a fully closed position and may remain in that position until an opening force is applied to the louvers 6. Multiple louver damping assemblies 218 may be used in some shutter panels and may be dispersed through the shutter panel to ensure a controlled louver closure. The actuation of the louver damping device 218 may be altered based on user preferences.

Figure 16:
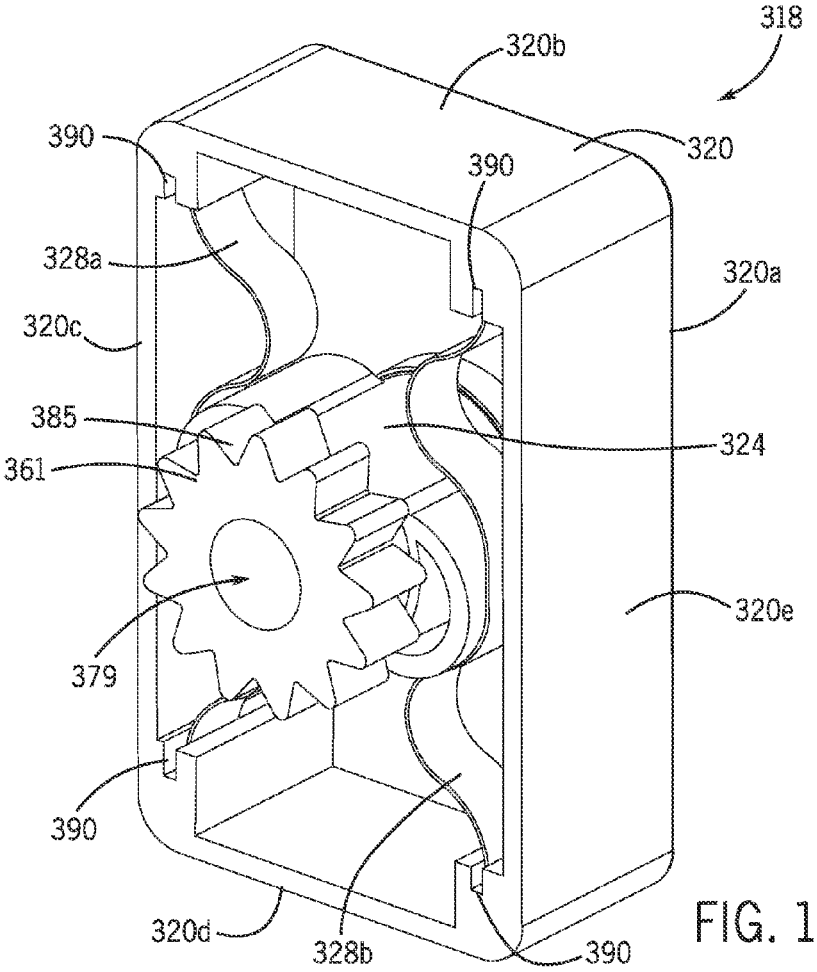
FIG. 16 is an isometric view of another louver damping assembly.
Figure 17:
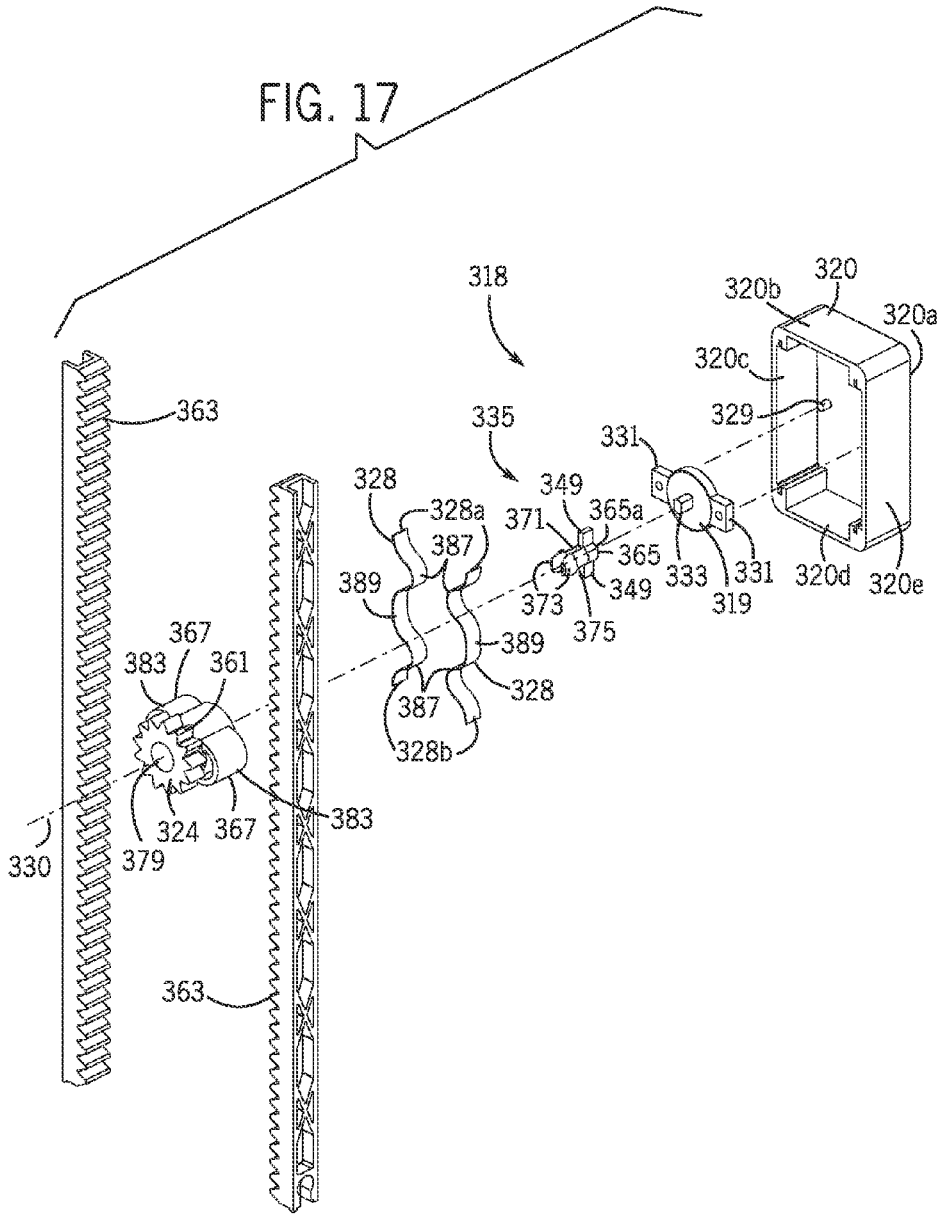
FIG. 17 is an exploded, isometric view of the louver damping assembly of FIG. 16.
Figure 18:
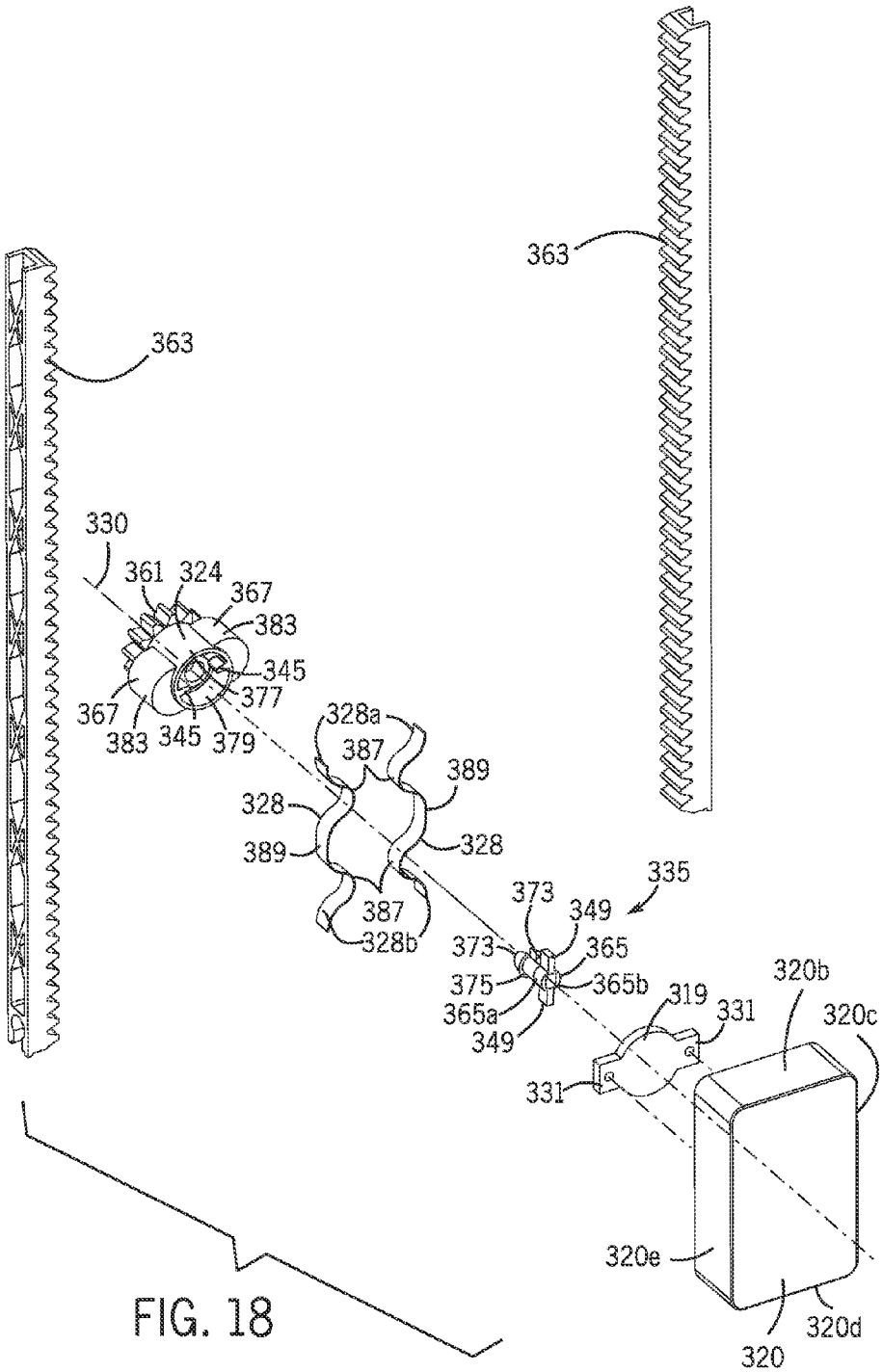
FIG. 18 is another exploded, isometric view of the louver damping assembly of FIG. 16.

With reference to FIGS. 16-19C, another louver damping device 318 is provided. With reference to FIGS. 16-18, the louver damping device 318 may include a housing 320, a rotary damper 319, a damper adapter 335, a rotary cam 324, and a pair of leaf springs 328. The rotary cam 324 may include a gear portion 361 for engagement with a pair of gear racks 363, which may form part of a gear track system embedded within a substantially hollow stile 8. Although the gear racks 363 are depicted as being generally elongated, the gear racks 363 may be shortened and form part of a louver rotation mechanism as discussed in U.S. Pat. No. 7,389,609, which is hereby incorporated by reference herein in its entirety.

The housing 320 may include a base 320*a* and multiple side panels 320*b*-320*e* attached to and extending away from the base 320 to form a substantially rectangular body closed at one end and open at the other end. Although not depicted, the housing 320 may include a removable cover that closes the open end of the substantially rectangular body. The cover may include an aperture for permitting passage of the gear portion 361 of the rotary cam 324 so that the gear portion 361 may engage the gear racks 363 exterior to the housing 320.

With continued reference to FIGS. 16-18, the rotary damper 319 may include one or more mounting ears 331, each of which may define an aperture 331*a* configured to receive a mounting pin 329 that protrudes from the base 320*a* of the housing 320. The rotary damper 319 may be mounted to the housing 320 in many other manners, including by use of various types of fasteners. The rotary damper 319 may include an operative shaft 333. The rotary damper 319 may function in a similar manner as the rotary damper 219. An example rotary damper 319 may be a dual direction damper available at McMaster-Carr® and identifiable by part number 6597K14.

The damper adapter 335 may interconnect the rotary damper 319 and the rotary cam 324. The damper adapter 335 may include a body 365 that includes an outer wall 365*a* and an inner wall 365*b*. The inner wall 365*b* may define a keyed socket corresponding in shape to and configured to receive the shaft 333 of the damper 319. A pair of wings 349 may extend radially outward from the outer wall 365*a* of the body 365 of the damper adapter 335. The wings 349 may be diametrically opposed about the outer wall 365*a*. A latch feature 371 may extend longitudinally from one end of the body 365. The latch feature 371 may include two resilient, transversely spaced arms 373 each having a barb 375 formed on a distal end relative to the body 365 of the damper adapter 335.

With continued reference to FIGS. 16-18, the rotary cam 324 may include a body 377 defining a recessed opening 379 configured to receive the damper adapter 335. The resilient arms 373 of the damper adapter 335 may pass through a portion of the recessed opening 379 and the barbs 375 may snapingly engage an inner, transversely-oriented wall 381 of the rotary cam 324 (see FIGS. 19A-19C) to attach the damper adapter 335 to the rotary cam 324. For example, during passage through a lengthwise-extending bore defined by an inner wall of the rotary cam 324, the resilient arms 373 may be elastically deformed toward one another in a transverse direction. Once the barbs 375 axially surpass the transversely-oriented wall 381 of the rotary cam 324, the resilient arms 373 may elastically move away from one another in a transverse direction, thereby engaging the barbs 375 with the inner, transversely-oriented wall 381. An abutment surface may contact or abut an opposing transversely-oriented wall of the rotary cam 324 to substantially prevent further insertion of the damper adapter 335 through the lengthwise-extending bore of the rotary cam 324. As such, when attached together, the rotary cam 324 and the damper adapter 335 may be axially constrained, but rotatable, relative to another. As illustrated in FIGS. 17-18, the rotary cam 324, the damper adapter 335, and the damper 319 may be aligned along a longitudinal axis 330, which may be coaxial with a rotation axis of a louver 6.

The rotary cam 324 may include a pair of diametrically opposed tangs 345 that extend radially inward from the body 377 into the recessed opening 379 (FIG. 18). When the damper adapter 335 is attached to the rotary cam 324, the tangs 345 of the rotary cam 324 may reside within a rotational path of the wings 349 of the damper adapter 335. As such, during relative rotation between the rotary cam 324 and the damper adapter 335, the tangs 345 and the wings 349 may abut or contact one another.

The recessed opening 379 may extend through the body 377 of the rotary cam 324 and may be configured to receive a louver pin in an opposing relationship to the damper adapter 335. In this configuration, the louver pin and the damper adapter 335 may be aligned along the longitudinal axis 330 of the louver damping device 318. The louver pin and the rotary cam 324 may be non-rotatably keyed together with an interference or press fit or other keying structures, such as those previously discussed in connection with the louver pin 22 and the louver closure device 18.

With continued reference to FIGS. 16-18, the rotary cam 324 may include a pair of lobes 367 extending outward from opposing sides of the body 377 of the rotary cam 324. The lobes 367 may include an arcuate or curved outer cam surface 383. The lobes 367 may be substantially identical to one another. The lobes 367 may be axially separated from a louver pin side of the rotary cam 324 by the gear portion 361, which may include a plurality of external teeth 385 radiating outward from the body 377 of the rotary cam 324.

With continued reference to FIGS. 16-18, the leaf springs 328 may be substantially identical to one another. Each leaf spring 328 may be formed in a substantially sinusoidal shape with a pair of peaks 387 separated from each other by an elongated trough 389. Each leaf spring 328 may include two free ends 328*a*, 328*b*, both of which may reside in a substantially common plane with the trough 389. When associated with the housing 320 (FIGS. 16 and 19A-19C), the free ends 328*a*, 328*b* of each leaf spring 328 may be received in opposing, longitudinally-extending channels 390 formed in the housing 320. The channels 390 may permit one or both of the free ends 328*a*, 328*b* of each leaf spring 328 to extend away from one another when the leaf spring 328 is elastically deformed. That is, at least one end 328*a*, 328*b* of each leaf spring 328 may not be fully seated in a respective channel 390 so that each leaf spring 328 may elastically deform in a lengthwise or flattening direction. Alternatively, each leaf spring 328 may include a pinned end. For example, at least one end 328*a*, 328*b* of each leaf spring 328 may be include a lengthwise extending slot and a pin may be extended through the slot to permit axial movement of the respective end of the leaf spring 328 relative to the housing 320. When the leaf springs 328 are associated with the housing 320 (FIGS. 16 and 19A-19C), the peaks 387 and troughs 389 of the leaf springs 328 may be aligned with one another in a confronting relationship.

Figure 19A:
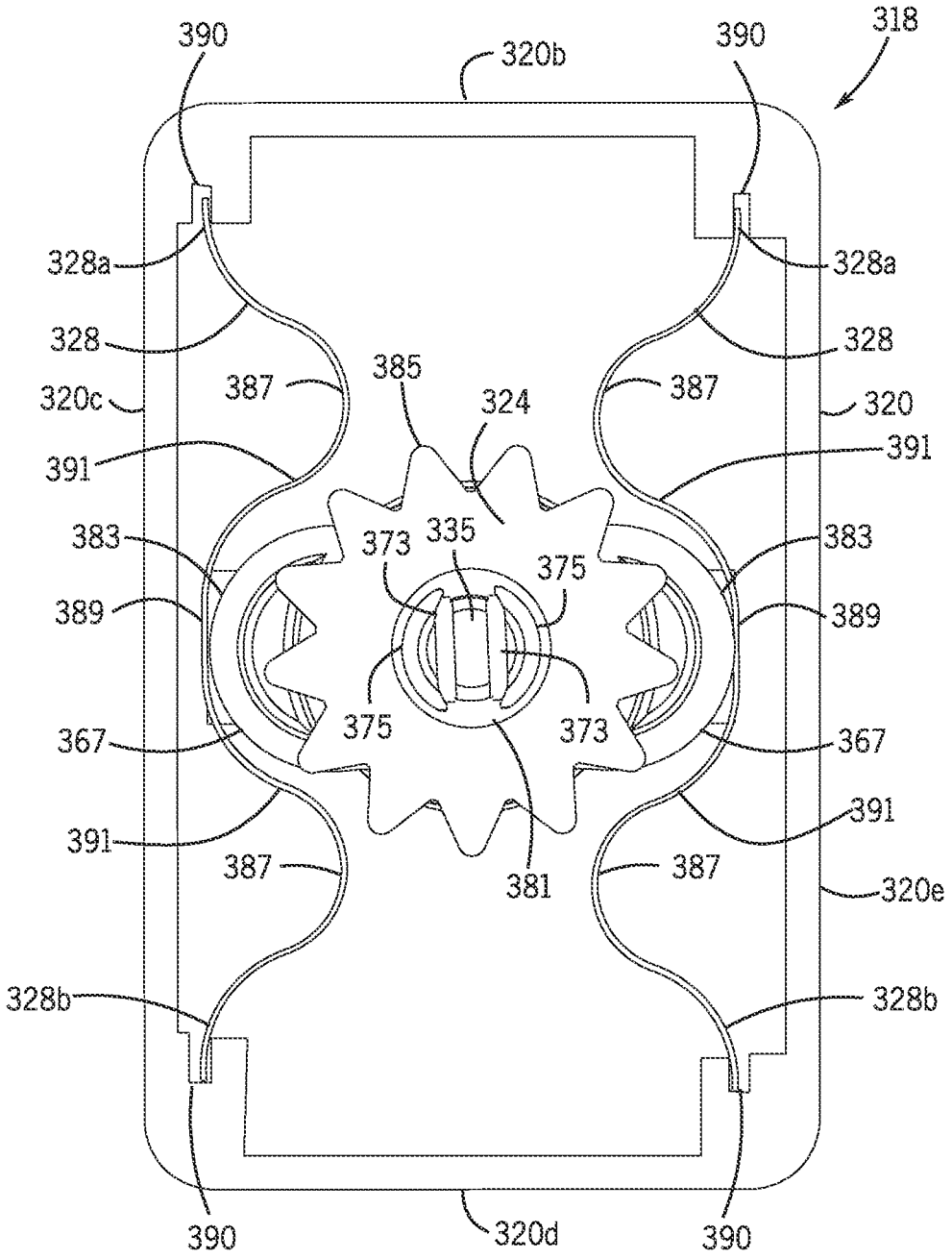
FIG. 19A is a front elevation view of the louver damping assembly of FIG. 16 in a first position, which may correspond to a fully-opened louver position.
Figure 19B:
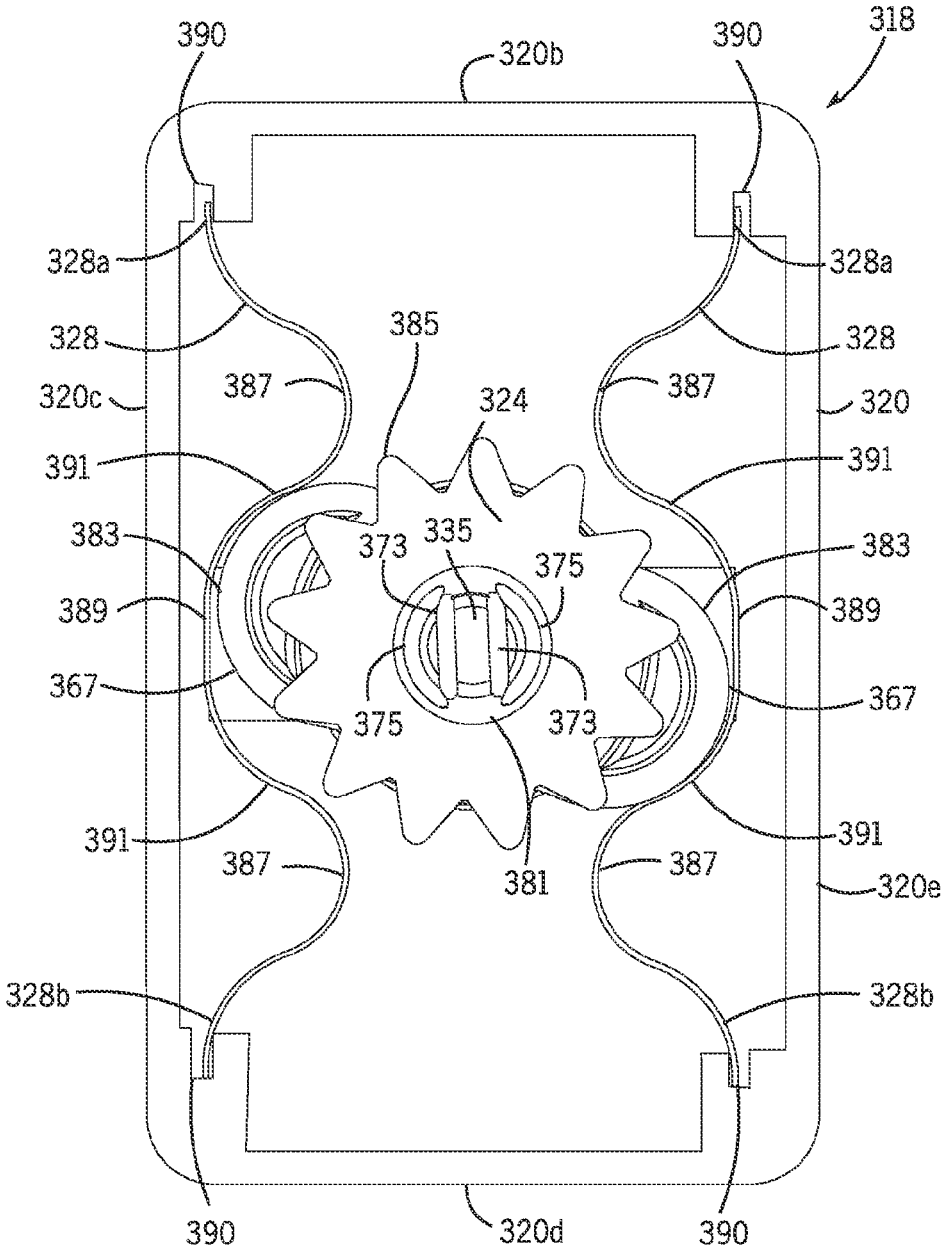
FIG. 19B is a front elevation view of the louver damping assembly of FIG. 16 in a second position, which may correspond to a partially-opened louver position.
Figure 19C:
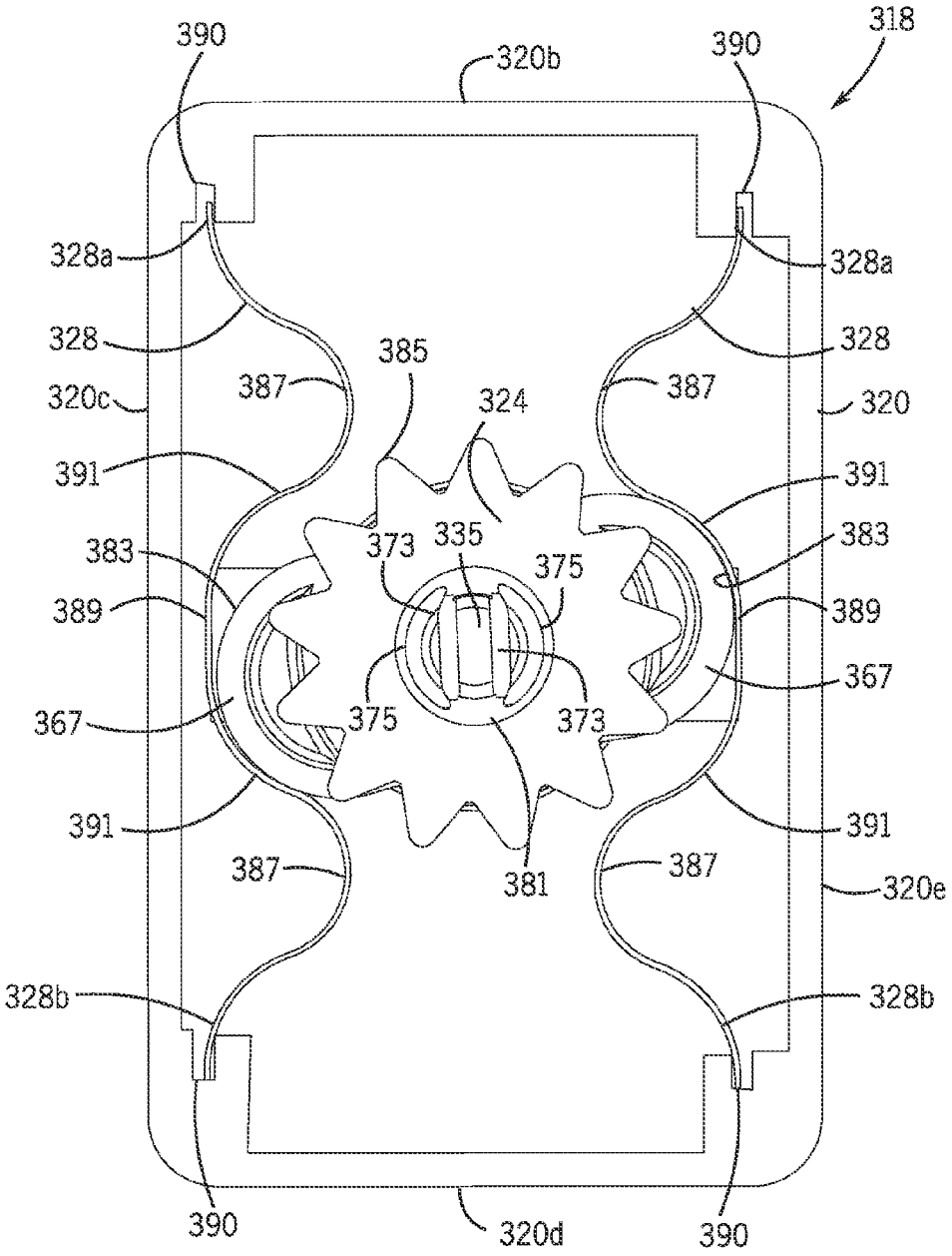
FIG. 19C is a front elevation view of the louver damping assembly of FIG. 16 in a third position, which may correspond to another partially-opened louver position.

With reference to FIGS. 19A-19C, the louver damping device 318 is illustrated in an assembled configuration with the rotary cam 324 positioned between the leaf springs 328. In the assembled configuration, the lobes 367 of the rotary cam 324 may be positioned adjacent opposing troughs 389 of the leaf springs 328. With reference to FIG. 19A, the louver damping device 318 is depicted in a first position, which may correspond to a fully-opened louver position. In this position, each lobe 367 may be positioned substantially equidistant between successive peaks 387 of a corresponding leaf spring 328.

Similar to the louver closure device 18, the louver tension device 118, and the louver damping device 218, the louver damping device 318 may be coupled to a louver 6 so that at least one component of the louver damping device 318 may rotate in unison with the louver 6. As previously discussed, the rotary cam 324 may be non-rotatably coupled to a louver pin to transfer torque between the louver 6 and the rotary cam 324. With reference back to FIGS. 17-18, a user initiated force may be transmitted through the gear racks 363, which may link multiple louvers 6 together. The gear tracks 363 may interface with opposing sides of the gear portion 361 of the rotary cam 324 such that substantially linear movement of each of the gear tracks 363 in generally opposite directions relative to one another may rotate the rotary cam 324 about the longitudinal axis 330 of the louver damping device 318. As the rotary cam 324 may be non-rotatably coupled to a louver 6 through a louver pin (such as the louver pin 22), rotation of the rotary cam 324 may cause rotation of the louver 6. Thus, the operable movement of the gear racks 363 may rotate the rotary cam 324, which in turn may rotate the louver 6. Although not depicted, the louver pin closure device 18, the louver tension device 118, and the louver damping device 218 may be slightly modified to operate in connection with the gear racks 363. For example, the louver pin 22 or the housing 20, 120, 220 may include external teeth configured to operatively engage the gear racks 363. In this manner, the louver closure device 18, the louver tension device 118, the louver damping device 218, 318, or a combination thereof may be used in connection with a shutter panel 2 employing a gear rack drive or operating system.

With continued reference to FIG. 19A, as the louver 6 is rotated from the fully-opened position toward a closed position through motion of the gear racks 363 relative to one another, the rotary cam 324 may rotate in unison with the louver 6. As the louver 6 approaches an automatic closure angular range (based on inclusion of a louver cam assembly 18 within the shutter panel 2), the lobes 367 of the rotary cam 324 may approach sidewalls 391 of the peaks 387 of the leaf springs 328 (FIGS. 19B and 19C), the tangs 345 on the rotary cam 324 may approach the wings 349 on the damper adapter 335, or both. The rotary cam 324, the leaf spring 328, or both may be configured such that the lobes 367 of the rotary cam 324 may contact or engage the sidewalls 391 of the peaks 387 simultaneously or substantially simultaneously with initiation of the automatic closure of the louver 6. Additionally or alternatively, the tangs 345, the wings 349, or both may be configured such that the tangs 345 of the rotary cam 324 may contact or engage the wings 349 of the damper adapter 335 simultaneously or substantially simultaneously with initiation of automatic closure of the louver 6, thereby engaging the damper 319 (through the operative shaft 333) simultaneously or substantially simultaneously with the initiation of the automatic closure of the louver 6. Thus, as the louver closure device 18 drives the louver 6 toward a fully-closed position, the lobes 367 of the rotary cam 324 may contact and resiliently deform the sidewalls 387 of the peaks 391 of the leaf springs 328, which may generally resist or dampen the closure motion of the louver 6. Additionally or alternatively, as the louver closure device 18 drives the louver 6 toward a fully closed position, the damper adapter 335 may selectively couple the rotary cam 324 and the damper 319 to generally resist or dampen the closure motion of the louver 6.

To reset or re-center the wings 349 of the damper adapter 335 relative to the tangs 345 of the rotary cam 324 (thereby resetting the damper deadband to the fully-opened louver position), the lobes 367 of the rotary cam 324 and the leaf springs 328 may be used on a smaller scale in association with the damper adapter 335. That is, the body 365 of the damper adapter 335 may include lobes protruding from opposite sides of the body 365 that selectively contact or engage peak sidewalls of opposing leaf springs based on the angular orientation of the louver 6. As the peak sidewalls of the opposing leaf springs may elastically deform during automatic louver closure, the leaf springs may store potential energy that may be released as the louver 6 is rotated from a fully-closed position toward a fully-opened position, which in turn may rotate the damper adapter 335 into its louver fully-opened position through the contact or engagement of the leaf springs and the lobes associated with the body 365 of the damper adapter 335. Additionally or alternatively, a button may be associated with a lobe 367 of the rotary cam 324 and selectively engagable with a wing 349 of the damper adapter 335. A sidewall 387 and/or peak 391 of a corresponding leaf spring 328 may depress the button as the louver 6 is approaching full closure, which may cause the button to contact a wing 349 of the damper adapter 335, which may rotate the damper adapter 335 and reorient or re-center the wings 349 of the damper adapter 335 relative to the tangs 345 of the rotary cam 324.

Figure 20:
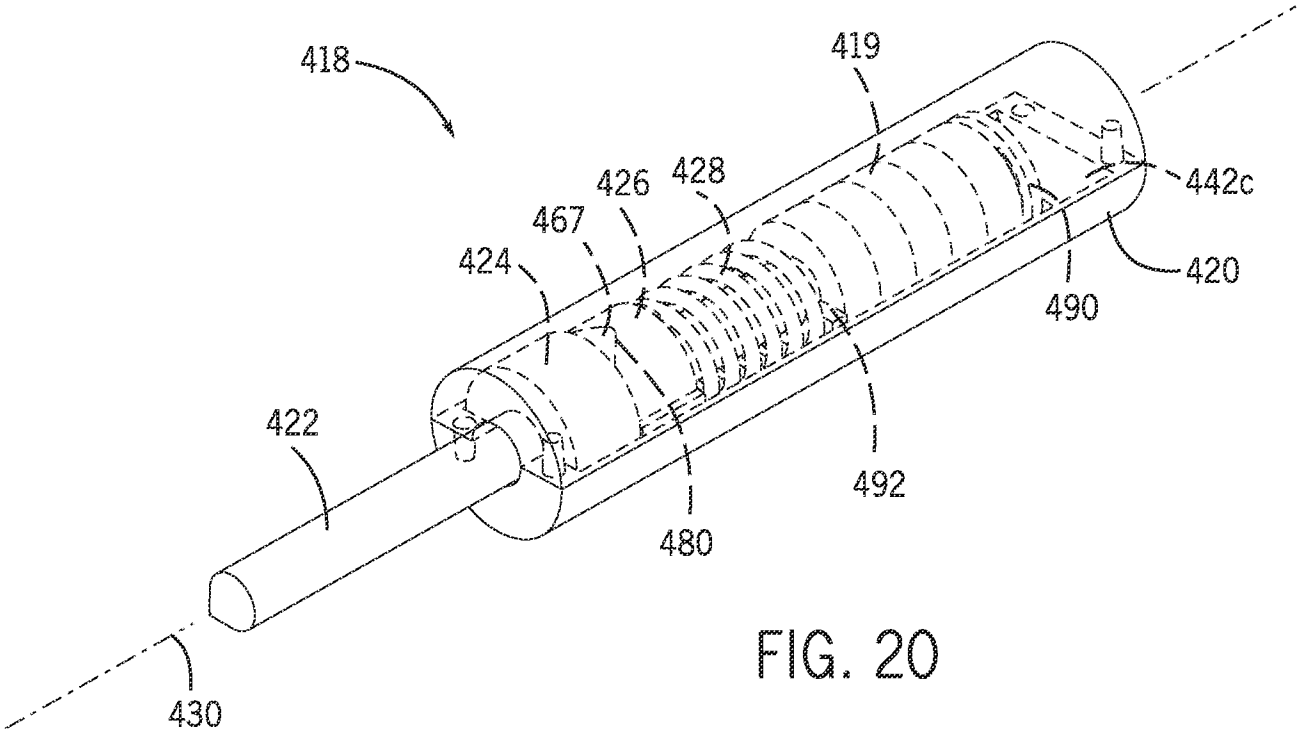
FIG. 20 is an isometric view of a combined louver closure and damping assembly.
Figure 21:
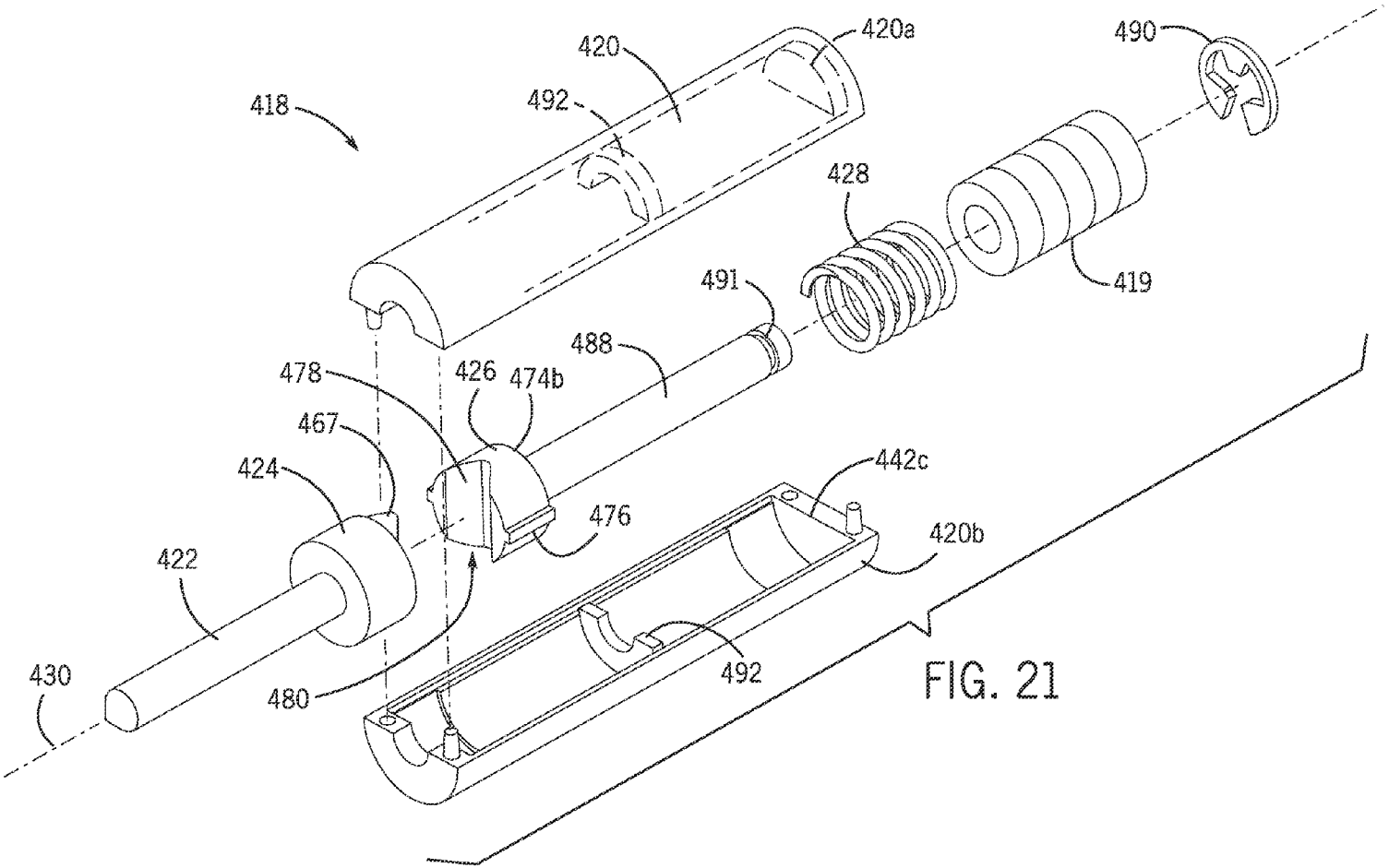
FIG. 21 is an exploded, isometric view of the louver closure and damping assembly of FIG. 20.
Figure 22:
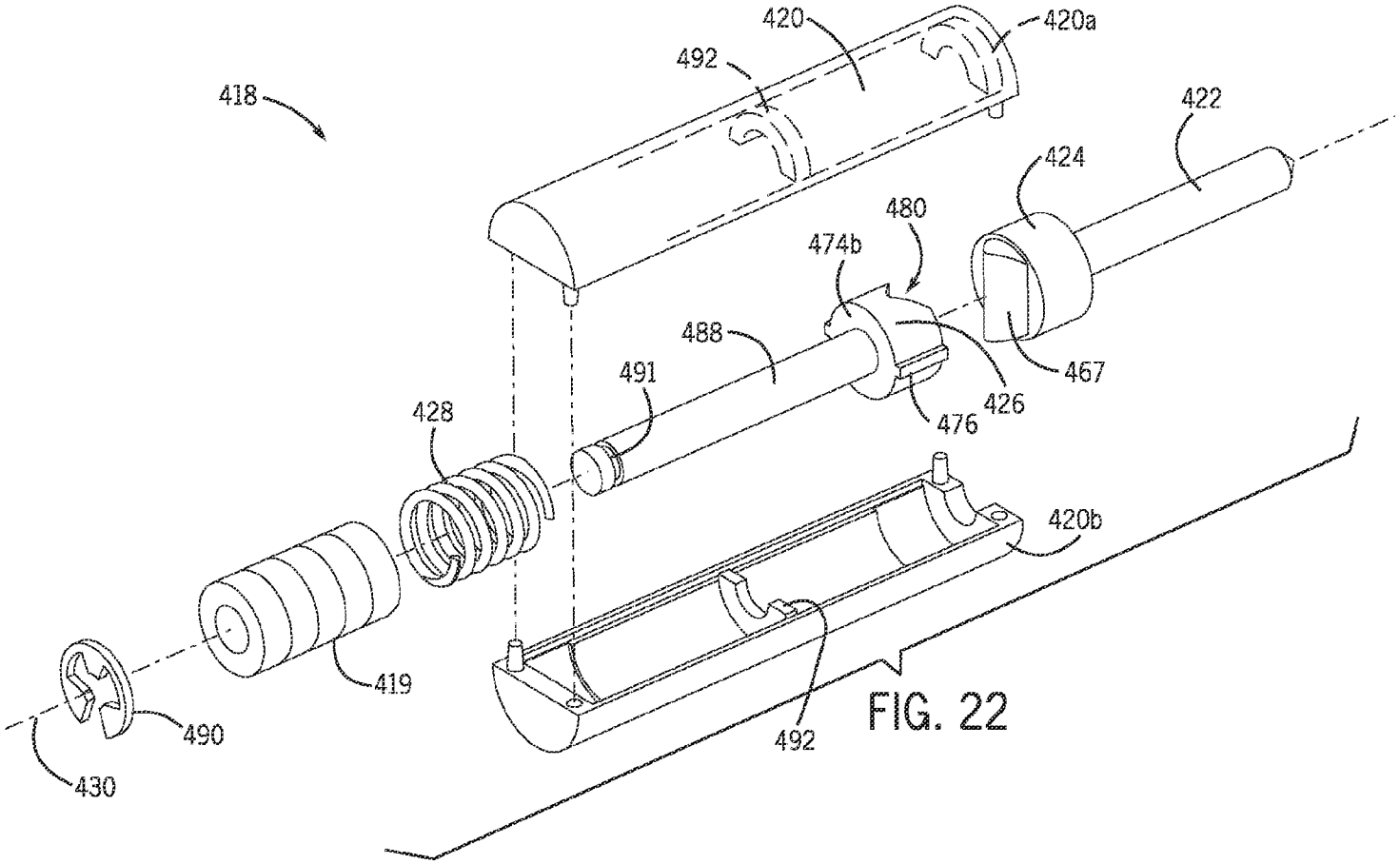
FIG. 22 is another exploded, isometric view of the louver closure and damping assembly of FIG. 20.

With reference to FIGS. 20-22, a louver closure and damping assembly 418 is provided in association with a common housing 420. The preceding discussion of the housing 20, the louver pin 22, the rotary cam 24, the linear cam 26, and the compression spring 28 should be considered equally applicable to the louver closure and damping assembly 418, except as noted in the following discussion. The reference numerals used in FIGS. 20-22 generally correspond to the reference numbers used in FIGS. 1-10 to reflect the similar parts and components, except the reference numerals are incremented by four hundred.

With continued reference to FIGS. 20-22, the louver closure and damping assembly 418 may include a housing 420, a louver pin 422, a rotary cam 424, a linear cam 426, a compression spring 428, and a linear damper 419, all of which may be aligned along a longitudinal axis 430 of the louver closure and damping assembly 418. The rotary cam 424, the linear cam 426, the compression spring 428, and the linear damper 419 all may be at least partially encased or received within the housing 420. The louver pin 422 may be rotatably supported by the housing 420 and may be non-rotatably coupled to the rotary cam 424. The louver pin 422 and the rotary cam 424 may be formed as a single part (as may be the louver pin 22 and the rotary cam 24) or the louver pin 422 and the rotary cam 424 may be formed as separate parts non-rotatably keyed together with a keying structure, such as that depicted in FIGS. 1-10 in relation to the louver pin 22 and the rotary cam 24.

The linear cam 426 may include a longitudinally-extending rod 488 protruding from an end 474*b* of the linear cam 426. The rod 488 may extend along the longitudinal axis 430 of the louver closure and damping assembly 418 through an inner space of the compression spring 428 and the damper 419. A fastener, such as a clip 490, may be interference or press fit within a circumferential groove 491 formed in a distal end of the rod 488 that extends axially beyond the damper 419.

With reference to FIG. 20, the louver closure and damping assembly 418 is illustrated in a first position, which may correspond to a fully-closed louver position. In the first position, the protrusion 467 of the rotary cam 424 may be substantially fully seated within the groove 480 formed in the linear cam 426. The compression spring 428 may be positioned between the linear cam 426 and a stationary wall 492 of the housing 420. The compression spring 428 may bias the linear cam 426 into the fully seated position with the rotary cam 424. As the rod 488 may be attached to the linear cam 426, linear movement of the cam 426 toward the rotary cam 424 may cause the clip 490 to compress the linear damper 419 between the clip 490 and the stationary wall 492, as illustrated in FIG. 20. Thus, the damping or resistive force of the damper 419 may generally oppose the spring force of the compression spring 428. The spring force of the compression spring 428 may be greater in magnitude than the damping force of the damper 419.

With continued reference to FIG. 20, to move a louver 6 from a fully-closed position toward a fully-opened position, the louver pin 422 may be rotated relative to the linear cam 426, which may cause the protrusion 467 of the rotary cam 424 to unseat from the groove 480 of the linear cam 426. The unseating of the protrusion 467 from the groove 480 may cause the linear cam 426 to slide along the longitudinal axis 430 relative to the housing 420 away from the rotary cam 424 toward the stationary wall 492, thereby compressing the compression spring 428. The sliding movement of the linear cam 426 also may cause the clip 490 to move axially away from the stationary wall 492, thereby allowing the damper 419 to expand, for example. The louver pin 422 may continue to be rotated relative to the linear cam 426 until the protrusion 467 may be substantially orthogonal to the groove 480, at which point the louver 6 may be oriented in a fully-opened position. When the louver 6 is in the fully-opened position, the clip 490 may abut or contact the shoulder 442*c* of the housing 420.

With continued reference to FIG. 20, to move the louver 6 from the fully-opened position toward the fully-closed position, the louver pin 422 may be rotated relative to the linear cam 426, which may cause the protrusion 467 of the rotary cam 424 to rotate relative groove 480 of the linear cam 426. Once the protrusion 467 substantially aligns with an edge of the groove 480, the compression spring 428 may slide the linear cam 426 along the longitudinal axis 430 relative to the housing 420 away from the stationary wall 492 toward the rotary cam 424, thereby rotating the rotary cam 424 to further align the protrusion 467 with the groove 480. The resulting rotation of the rotary cam 424 may cause the louver pin 422 to rotate in a louver closing direction, which may rotate the louver 6 toward the fully-closed position. The sliding movement of the linear cam 426 also may cause the clip 490 to move axially toward the stationary wall 492, thereby compressing the damper 419. The damping or compression rate of the damper 419 may control or govern the spring force of the compression spring 428, which may result in a generally consistent, slow, and/or smooth louver closure. The louver 6 may be fully closed when the protrusion 467 of the rotary cam 424 is substantially fully seated within the groove 480 of the linear cam 426. The damper 419 may be a compressible material, such as a closed-cell or open-cell foam. In one implementation, the damper 419 is a closed-cell foam.

Figure 23:
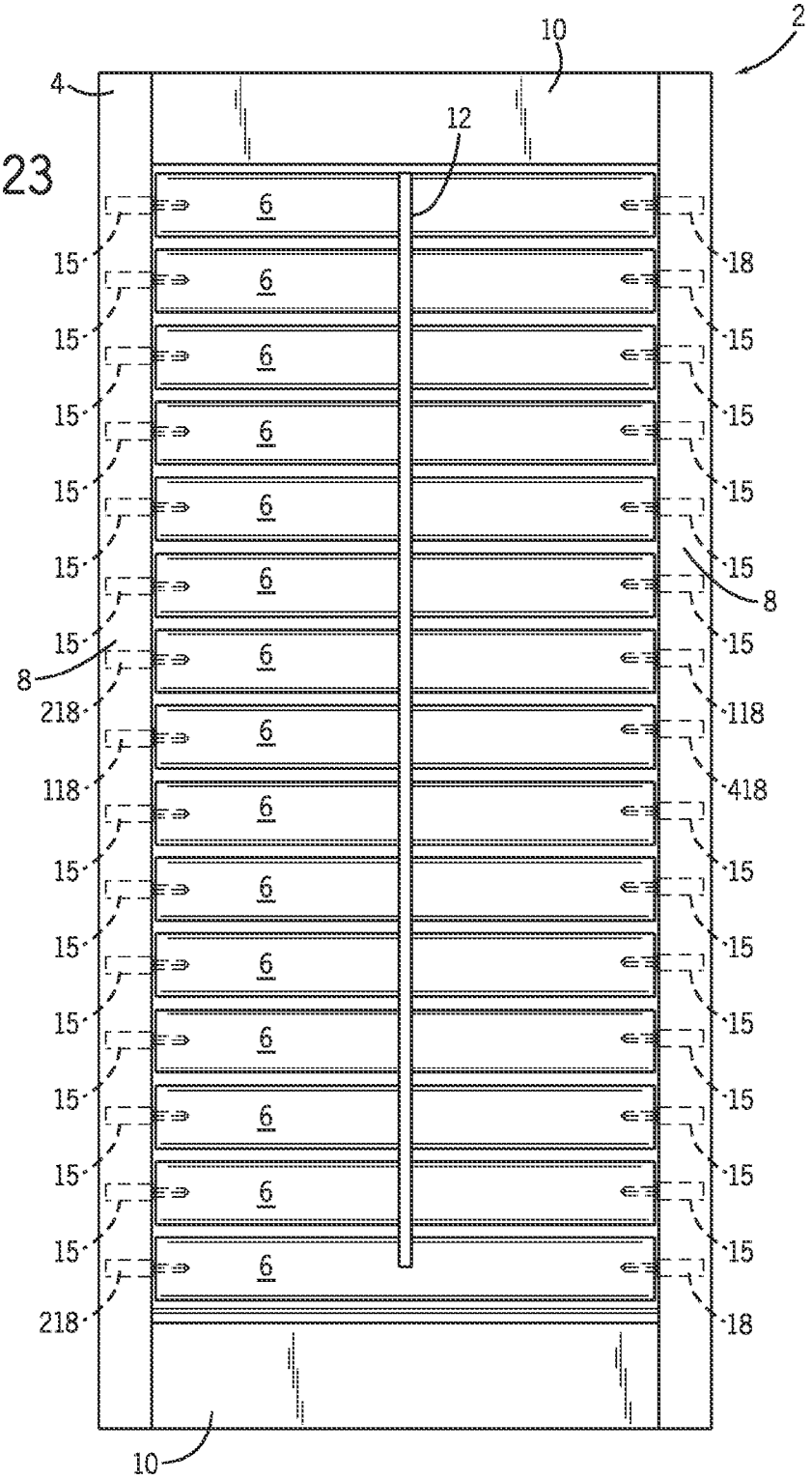
FIG. 23 is a front elevation view of a louvered shutter with a standard louver pin, a louver tension assembly, a louver closure assembly, and a louver damping assembly.

With reference to FIG. 23, a shutter panel 2 with a standard louver pin 15, a louver tension device 118, a louver closure device 18, a louver damping device 218, 318, and a louver closure and damping assembly 418 is provided. The shutter panel 2 may include any combination and/or arrangement of the standard louver pin 15, the louver tension device 118, the louver closure device 18, the louver damping device 218, 318, and the louver closure and damping assembly 418. The louver closure device 18, the louver tension device 118, the louver damping device 218, 318, the louver closure and damping assembly 418, or a combination thereof may be used in connection with a shutter panel 2 employing a gear rack operating system, a pulley operating system, a tilt bar operating system, or other louver operating systems. As the louvers 6 in a shutter panel 2 may be coupled together to move in unison (such as by a tilt bar, a gear track system, a pulley system, or other drive system), a louver device may be removably attached to one end of a single louver 6, one end of multiple louvers, both ends of a single louver, both ends of multiple louvers, or a combination thereof. If multiple louver devices are individually attached to multiple louvers, the selected louvers may be immediately adjacent one another, evenly distributed throughout the shutter panel, or randomly chosen. The louver devices may be attached to a stile, a rail, or other structures of the panel. As such, one or more louver devices may be used in connection with a shutter panel 2. The number, location, or both of the louver devices may be based on the number of louvers 6, the weight of the louvers 6, the size (height and width, for example) of the shutter panel 2, and other suitable factors.

The components or parts discussed herein may be constructed from various types of materials, including metallic and non-metallic materials. In one implementation, the various housings, rotary cams, cams, and louver pins are made from Lustran® acrylonitrile butadiene styrene (ABS) 433. In one implementation, the various springs are made from stainless steel. The components or parts discussed herein may include various surface finishes or textures. In one implementation, the various housings, rotary cams, cams, and louver pins include a polish of SPI-A2 (Society of Plastics Industry).

The foregoing description has broad application. The louver closure, damping, and tension assemblies may be incorporated into any type of shutter panel, including shutter panels with solid wood frames and hollow vinyl frames. Further, the louver closure, damping, and tension assemblies may be used in connection with any type of louver actuation system, including gear rack systems, pulley systems, tilt bars, and other louver actuation systems. Moreover, the louver closure, damping, and tension assemblies may be provided as a self-contained module or unit that may be retrofit into existing shutter panels. Furthermore, the louver closure, damping, and tension assemblies may include a relatively small outer envelope, which may not compromise the integrity of the frame of the shutter panel. For example, the louver closure, damping, and tension assemblies may include an outer envelope of about one inch in length and about three-eighths of an inch in diameter. Accordingly, the discussion of any example is meant only to be explanatory and is not intended to suggest that the scope of the disclosure, including the claims, is limited to these examples. In other words, while illustrative examples of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

The phrases "at least one", "one or more", and "and/or", as used herein, are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof are open-ended expressions and can be used interchangeably herein.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

What is claimed is:

1. A shutter panel for an architectural opening, the shutter panel comprising:

a frame;

a louver coupled to the frame and rotatable relative to the frame about a longitudinal axis of the louver to move the louver across a non-automatic angular range of louver positions in which the louver is maintained in a position in which it is placed by a user, and an automatic self-closure angular range of louver positions; and a louver closure assembly coupled to the louver and operable on the louver when the louver is rotated by a user into the automatic self-closure angular range of louver positions to drive the louver without further user interaction about the rotational axis into a closed position relative to an adjacent louver to block light from passing between the louver and the adjacent louver.

2. The shutter panel of claim 1, wherein the louver closure assembly is operable to provide a holding force that maintains the louver in the position in which it is placed by a user when the louver is within the non-automatic angular range of louver positions.

3. The shutter panel of claim 1, further comprising a louver pin coupled to the louver;

wherein the louver closure assembly and the louver pin are aligned along the longitudinal axis of the louver.

4. The shutter panel of claim 1, wherein:

the non-automatic angular range of louver positions is defined across a first range of angular positions of the louver;

the automatic self-closure angular range of lower positions is defined across a second range of angular positions of the louver that differs from the first range of angular positions; and the first range of angular positions including a larger range of angular position than the second range of angular positions.

5. The shutter panel of claim 1, further comprising a damper acting on the louver to resist rotation of the louver towards the closed position as the louver closure assembly automatically drives the louver through the automatic self-closure angular range of louver positions to the closed position.

6. The shutter panel of claim 5, wherein the damper includes an angular range of damper non-engagement corresponding to the non-automatic angular range of louver positions.

7. The shutter panel of claim 6, further comprising a centering system configured to substantially center the damper within the angular range of non-engagement.

8. The shutter panel of claim 5, wherein the louver closure assembly and the damper are at least partially received within a common housing.

9. A shutter panel for an architectural opening, the shutter panel comprising:

a frame;

a louver rotatably coupled to the frame and including a louver pin;

a damper operably associated with the louver; and a louver closure assembly operably associated with the louver and actuated based on an angular orientation of the louver, the louver closure assembly including a first cam member and a second cam member, the first cam member including a protuberance extending outwardly from a first base surface of the first cam member, the second cam member defining a groove configured to receive the protuberance;

wherein:

the protuberance defines opposed sloped surfaces that converge towards each other as the opposed sloped surfaces extend away from the first base surface;

when the protuberance begins to enter the groove of the second cam member, the second cam member is configured to move relative to the first cam member to cause the first cam member to rotationally drive the louver pin to rotate the louver to a closed position; and the damper is configured to resist rotation of the louver towards the closed position as the first cam rotationally drives the louver pin.

10. The shutter panel of claim 9, wherein the first cam member is rotatable relative to the second cam member.

11. The shutter panel of claim 9, wherein:

the louver pin interconnects the louver and the frame; and the louver pin is non-rotatably coupled to the first cam member.

12. The shutter panel of claim 9, wherein the first cam member, the second cam member, and the louver pin are aligned along a common axis.

13. The shutter panel of claim 9; wherein:

the louver closure assembly includes a biasing element; and the biasing element biases the second cam member into contact with the first cam member.

14. The shutter panel of claim 9, wherein the groove defines a trough spaced apart from a second base surface of the second cam member and includes opposed sloped surfaces extending between the second base surface and the trough such that the opposed sloped surfaces converge towards each other as the opposed sloped surfaces extend away from the second base surface.

15. The shutter panel of claim 9, wherein the damper is actuated substantially simultaneously with the louver closure assembly based on the angular orientation of the louver.

16. The shutter panel of claim 9, wherein the louver closure assembly and the damper are aligned along a common axis.

17. The shutter panel of claim 9, further comprising a louver tension assembly operably associated with the louver.

18. A shutter panel for an architectural opening, the shutter panel comprising:

a frame;

a louver rotatably coupled to the frame, the louver rotatable within a non-automatic angular range of louver positions in which the louver is maintained in a first position in which it is placed by a user, and an automatic self-closure angular range of louver positions in which the louver automatically rotates from a second position in which it is placed by a user into a closed position without further user interaction; and a damper operably associated with the louver to resist rotation of the louver, the damper actuated based on an angular orientation of the louver;

wherein:

the damper is configured to be rotationally disengaged from the louver as the louver is rotated through the non-automatic angular range of louver positions such that the louver rotates relative to the damper across the non-automatic angular range of louver positions; and the damper is configured to be rotationally engaged with the louver as the louver is rotated through the automatic self-closure angular range of louver positions such that the damper acts on the louver to resist rotation of the louver as the louver moves through the automatic self-closure angular range of louver positions to the closed position.

19. The shutter panel of claim 18, further comprising a deadband device arranged to selectively engage or disengage the damper relative to the louver based on the angular orientation of the louver, the deadband device including a first deadband member non-rotatably coupled to the louver and a second deadband member non-rotatably coupled to the damper.

20. The shutter panel of claim 19, wherein:

the first and second deadband members are aligned along a common axis; and the first and second deadband members are angularly offset about the common axis when the damper is rotationally disengaged from the louver.

21. The shutter panel of claim 19, further comprising a centering device arranged to substantially center the damper within a deadband range of the deadband device, the centering device including a first cam member configured to engage the second deadband member.

22. The shutter panel of claim 21, wherein the first cam member is biased into contact with the second deadband member by a biasing element.

23. The shutter panel of claim 21, wherein the first deadband member, the second deadband member, and the first cam member are at least partially received within a common housing.

24. The shutter panel of claim 19, wherein:

the first deadband member defines a first end face and includes at least one first protrusion extending outwardly from the first end face towards the second deadband member;

the second deadband member defines a second end face and includes at least one second protrusion extending outwardly from the second end face towards the first deadband member; and the at least one first protrusion is configured to selectively engage with at least one second protrusion so as to rotationally engage the damper with the louver across the automatic self-closure angular range of louver positions.

25. The shutter panel of claim 24, wherein:

the at least one first protrusion is configured to be rotationally offset from the at least one second protrusion as the louver is rotated across the non-automatic angular range of louver positions such that the first deadband member rotates relative to the second deadband member; and the at least one first protrusion is configured to contact the at least one second protrusion as the louver is rotated across the automatic self-closure angular range of louver positions such that the second deadband member rotates together with the first deadband member.

26. The shutter panel of claim 24, further comprising a cam member configured to be biased into engagement with the second deadband member;

wherein:

the cam member defines an axially extending recess and the second deadband member includes a projection configured to be received within the recess when the louver is disposed at a given louver position within the non-automatic angular range of louver positions; and the second deadband member is configured to rotate relative to the first deadband member as the projection is received within the recess.

27. The shutter panel of claim 18, wherein:

the non-automatic angular range of louver positions is defined across a first range of angular positions of the louver;

the automatic self-closure angular range of louver positions is defined across a second range of angular positions of the louver that differs from the first range of angular positions; and the first range of angular positions including a larger range of angular position than the second range of angular positions.

28. The shutter panel of claim 18, wherein the damper is a rotary damper or a linear damper.

29. A shutter panel for an architectural opening, the shutter panel comprising:

a frame;

a louver rotatably coupled to the frame, the louver rotatable across a range of angular positions between a closed position and an opened position; and a tension device operably associated with the louver and configured to retain the louver in an angular orientation, the tension device including:

a first tension member non-rotatably coupled to the louver; the first tension member defining a first planar surface;

a second tension member slidable relative to the first tension member, the second tension member defining a second planar surface;

a biasing element biasing the second planar surface into contact with the first planar surface; and a common housing within which the first tension member, the second tension member, and the biasing element are positioned;

wherein the first and second planar surfaces are maintained in frictional engagement with each other within an interior of said common housing as the louver is rotated across the range of angular positions from the closed position to the opened position.

30. The shutter panel of claim 29, wherein:

the louver includes a louver pin; and the first tension member is non-rotatably coupled to the louver pin.

31. The shutter panel of claim 29, wherein the first tension member, the second tension member, and the biasing element are aligned along a common axis.

* * * * *